US010131859B2

(12) United States Patent
Wolf et al.

(10) Patent No.: US 10,131,859 B2
(45) Date of Patent: Nov. 20, 2018

(54) CORROSION INHIBITOR COMPOSITIONS FOR OXYGENATED GASOLINES

(71) Applicant: Butamax (TM) Advanced Biofuels LLC, Wilmington, DE (US)

(72) Inventors: Leslie R. Wolf, Naperville, IL (US); James J. Baustian, St. Charles, IL (US)

(73) Assignee: Butamax Advanced Biofuels LLC, Wilmington, DE (US)

( * ) Notice: Subject to any disclaimer, the term of this patent is extended or adjusted under 35 U.S.C. 154(b) by 398 days.

(21) Appl. No.: 13/729,741

(22) Filed: Dec. 28, 2012

(65) Prior Publication Data

US 2013/0227878 A1 Sep. 5, 2013

Related U.S. Application Data

(60) Provisional application No. 61/581,902, filed on Dec. 30, 2011.

(51) Int. Cl.

| | |
|---|---|
| ***C10L 1/00*** | (2006.01) |
| ***C10L 10/04*** | (2006.01) |
| ***C10L 1/14*** | (2006.01) |
| ***C10L 1/18*** | (2006.01) |
| ***C10L 1/182*** | (2006.01) |
| ***C10L 1/188*** | (2006.01) |
| ***C10L 1/22*** | (2006.01) |
| ***C10L 1/222*** | (2006.01) |
| ***C10L 1/224*** | (2006.01) |
| ***C10L 1/232*** | (2006.01) |
| ***C10L 1/238*** | (2006.01) |
| ***C10L 1/2387*** | (2006.01) |
| ***C10G 75/02*** | (2006.01) |
| ***C10L 1/02*** | (2006.01) |
| ***C23F 11/12*** | (2006.01) |
| *C10L 1/12* | (2006.01) |
| *C10L 1/16* | (2006.01) |
| *C10L 1/185* | (2006.01) |
| *C10L 1/19* | (2006.01) |

(52) U.S. Cl.

CPC ..... *C10L 10/04* (2013.01); *C10G 75/02* (2013.01); *C10L 1/023* (2013.01); *C10L 1/14* (2013.01); *C10L 1/18* (2013.01); *C10L 1/1824* (2013.01); *C10L 1/1883* (2013.01); *C10L 1/221* (2013.01); *C10L 1/224* (2013.01); *C10L 1/2222* (2013.01); *C10L 1/2225* (2013.01); *C10L 1/232* (2013.01); *C10L 1/238* (2013.01); *C10L 1/2387* (2013.01); *C23F 11/126* (2013.01); *C10L 1/125* (2013.01); *C10L 1/1608* (2013.01); *C10L 1/1857* (2013.01); *C10L 1/19* (2013.01); *C10L 2200/0423* (2013.01); *C10L 2200/0469* (2013.01); *C10L 2230/14* (2013.01); *C10L 2270/02* (2013.01)

(58) Field of Classification Search

CPC .... C10L 10/04; C10L 1/14; C10L 1/18; C10L 1/1824; C10L 1/1883; C10L 1/19; C10L 1/023; C10L 1/221; C10L 1/2222; C10L 1/2225; C10L 1/224; C10L 1/232; C10L 1/238; C10L 1/2387

See application file for complete search history.

(56) References Cited

U.S. PATENT DOCUMENTS

| | | | | |
|---|---|---|---|---|
| 2,444,328 | A | 6/1948 | Blair | |
| 2,718,503 | A | 9/1955 | Rocchini | |
| 3,454,381 | A | 7/1969 | Eckert | |
| 4,227,889 | A | 10/1980 | Perilstein | |
| 4,305,730 | A | 12/1981 | Davis et al. | |
| 4,344,861 | A | 8/1982 | Levy | |
| 4,737,159 | A | 4/1988 | Phillips | |
| 5,080,686 | A | 1/1992 | Garrecht et al. | |
| 8,465,560 | B1 | 6/2013 | Wolf | |
| 8,734,543 | B2 | 5/2014 | Baustian | |
| 8,870,983 | B2 | 10/2014 | Baustian et al. | |
| 8,968,429 | B2 | 3/2015 | Baustian et al. | |
| 2006/0162243 | A1 | 7/2006 | Wolf | |
| 2008/0202561 | A1 | 8/2008 | Dumont et al. | |
| 2009/0099401 | A1 | 4/2009 | D'Amore et al. | |
| 2009/0199464 | A1* | 8/2009 | Wolf | C10L 1/023 44/451 |
| 2009/0292512 | A1 | 11/2009 | Wolf | |
| 2010/0307053 | A1 | 12/2010 | Kuberka et al. | |
| 2011/0023354 | A1 | 2/2011 | Wolf | |
| 2011/0283604 | A1 | 11/2011 | Foster et al. | |
| 2012/0144902 | A1 | 6/2012 | Torres-Ordonez | |

(Continued)

FOREIGN PATENT DOCUMENTS

| | | |
|---|---|---|
| CN | 1358827 | 7/2002 |
| GB | 1185801 A | 3/1970 |

OTHER PUBLICATIONS

Renewable Fuels Association, Corrosion Inhibitors in Fuel Ethanol, May 2010.*

Afton Chemical, BioTEC 9880, Specification and Distribution Additive, Corrosion Inhibitor for Ethanol and Ethanol Blended Gasoline, Jul. 31, 2011.

International Search Report dated Aug. 14, 2013, International Application No. PCT/US2012/000591.

*Primary Examiner* — Cephia D Toomer

(57) ABSTRACT

This invention relates to corrosion inhibitor additive combinations giving long acting performance in oxygenated gasoline blends comprising either low carbon number (<3) or high carbon number (greater than or equal to 4) alcohols or mixtures thereof and adapted for use in fuel delivery systems and internal combustion engines. The invention also is concerned with a process for conferring anti-corrosion properties to oxygenates in gasoline fuel mixtures wherein the oxygenate comprises biologically-derived butanol.

7 Claims, No Drawings

(56) References Cited

U.S. PATENT DOCUMENTS

| | | | |
|---|---|---|---|
| 2012/0240454 | A1 | 9/2012 | Boyd et al. |
| 2013/0180164 | A1 | 7/2013 | Wolf |
| 2013/0247450 | A1 | 9/2013 | Wolf |
| 2013/0247453 | A1 | 9/2013 | Baustian et al. |
| 2014/0005443 | A1 | 1/2014 | D'Amore et al. |
| 2014/0109467 | A1 | 4/2014 | Wolf |
| 2015/0007488 | A1 | 1/2015 | Baustian et al. |
| 2015/0007490 | A1 | 1/2015 | Torres-Ordonez et al. |
| 2015/0007491 | A1 | 1/2015 | Baustian et al. |
| 2015/0128486 | A1 | 5/2015 | Baustian et al. |

* cited by examiner

CORROSION INHIBITOR COMPOSITIONS FOR OXYGENATED GASOLINES

This application claims the benefit of U.S. Provisional Application No. 61/581,902, filed on Dec. 30, 2011; the entire contents of which are herein incorporated by reference.

FIELD OF THE INVENTION

This invention relates to corrosion inhibitor combinations giving long acting performance in oxygenated gasoline blends comprising either low carbon number (<3) or high carbon number (greater than or equal to 4) alcohols or mixtures thereof and adapted for use in fuel delivery systems and internal combustion engines. The invention also is concerned with a process for conferring anti-corrosion properties to oxygenates in gasoline fuel mixtures.

BACKGROUND OF THE INVENTION

Worldwide concern over the growing shortages of crude oil supplies has promoted the use of many materials as blending agents in gasoline to extend the fuel supply. Environmental concern has also promoted use of oxygenated gasoline in order to reduce emissions. Methanol, ethanol and t-butanol have emerged as the most widely used alcohol blending agents. Methanol, often in mixes with cosolvents such as tert-butanol, has been used in commercial gasoline.

The use of a polar oxygenates such as methanol, ethanol, butanol, in gasoline blends, however, has far reaching consequences. One of these is the creation of corrosion problems both in the logistic chain and in the vehicle itself. In pipelines and storage tanks, rust which normally would remain on the walls, is loosened by the alcohol and transported through the system.

Of perhaps greater concern with the use of commercial ethanol in gasoline blends are phase separation problems which occur because water containing ethanol has limited solubility in gasoline. When phase separation occurs, corrosion of many of the metals and alloys which make up the vehicle fuel distribution system and the vehicle engine is promoted due to water contacting the metals and metal alloys. Specifically, fuel tank terne plate, (steel coated with an alloy of lead 80-90% and tin 10-20%), zinc and aluminum diecast carburetor and fuel pump parts, brass fittings, steel lines, etc. can corrode when exposed to gasoline-ethanol fuel mixtures.

In addition to bioethanol and t-butyl ethyl ether, biologically-derived butanol or biobutanol is increasingly looked upon as bioethanol substitute because of its advantages over bioethanol from fuel preparation point of view i.e. higher energy content, lower miscibility with water, lower vapour pressure and lower corrosivity. Biobutanol concentration in fuel can reach up to 30% v/v without the need for engine modification. Since the butanol fuel contains oxygen atoms, the stoicliometric air/fuel ratio is smaller than for gasoline and more fuel needs to be injected for the same amount of air induced. The oxygen content has been found to improve combustion, therefore lower CO and HC emissions can be expected. Biobutanol and its mixtures can be used directly in the current gasoline supply system, such as transportation tanks and re-fuelling infrastructure. Biobutanol can be blended with gasoline without additional large-scale supply infrastructure, which is a big benefit as opposed to the bioethanol use. Finally biobutanol is non-poisonous and non-corrosive and it is easily biodegradable and does not cause risk of soil and water pollution.

Compared to ethanol, biobutanol exhibits important advantages upon blending with gasoline. The mixtures have better phase stability in presence of water, low-temperature properties, oxidation stability during long-term storage, distillation characteristics and volatility with respect to possible air pollution. Due to the fact that oxygen content in biobutanol is lower than in ethanol, biobutanol can be added to the gasoline in higher concentrations with respect to regulated limits for the oxygen content in gasoline. Higher biobutanol content in gasoline does not require engine modification. The heating value (energy density) of biobutanol is close to that of gasoline, which has a positive effect on the fuel consumption. Biobutanol has a slightly higher density compared to gasoline but the increase in density of biobutanol/gasoline mixtures is so small that it does not cause problems with fulfilling limits for automotive gasoline containing up to 30% v/v biobutanol.

This problem of corrosion of oxygenate containing gasoline can be remedied to some extent by the use of anhydrous or substantially anhydrous oxygenates as a blending agent. However, if the fuel mixture is exposed to water, oxygenates such as ethanol will experience phase separation. Even in the absence of phase separation, corrosion can be brought about by the presence of trace amounts of acetic acid, acetaldehyde, ethyl acetate and butanol in the fuel blends which are formed during production of the ethanol. Other corrosion problems can arise from dissolved mineral salts, such as highly corrosive sodium chloride, which may be picked up by the fuel during production, storage and transportation.

In the late 1980s, additive companies introduced special corrosion inhibiting additives for oxygenated gasolines. These additives typically are combinations of carboxylic acid type corrosion inhibitors used in conventional unoxygenated gasoline and an amine neutralizer. Many of these materials are assumed to function by becoming adsorbed onto the metallic surface for which protection is desired. This adsorption results in the formation of a physical barrier which interferes with the transfer of corrosive reactants through the metal-solution interface. These additives have been employed with good success in oxygenated gasoline containing ethanol or methanol plus cosolvents. However, what has not been well established is the long term effectiveness of corrosion inhibitors in oxygenated gasolines.

Testing of steel corrosion inhibitors for gasoline is commonly done with the NACE test. (National Association of Corrosion Engineers Method TM-01-72). However, because of OEM concerns about the stability of oxygenated gasoline blends, including continued effectiveness of corrosion inhibitors, additive suppliers have reported heat-aged performance in the NACE test and the Renewal Fuels Association (RFA) has provided an industry guideline that recommends NACE testing after an extended ambient aging period.

Thus, there is presently a need for a corrosion inhibitor that will either curb or prevent the corrosion of conventional systems which are used to store and transport commercial ethanol in gasoline fuel blends and one that will curb or prevent corrosion of the vehicle fuel systems in which these fuels are ultimately used. It is important that the corrosion inhibitor be effective in very small quantities to avoid any adverse effects, such as adding to the gum component of the fuel, etc., as well as to minimize cost. The corrosion inhibitor should also not emulsify water.

Of particular concern is OEM requirements for corrosion inhibitor effectiveness over at least 120 days to emulate expected shelf life. After new automobiles, trucks and motor vehicles, in general, are assembled, their fuel tanks are generally filled to some extent with an appropriate fuel before the vehicles are shipped to their point of sale and delivery to the ultimate customer. Because of the global nature of the motor vehicle industry, with the assembly of the vehicles often times taking place in a different part of the world relative to the point of sale of the vehicle, the fuel that is placed in these fuel tanks often stands unused for extended periods of time during shipment and storage of the vehicles.

During these periods of time, the fuel in the fuel tanks, now effectively being in storage, must retain its initial integrity and not degrade with the degradation exhibiting itself through subsequent starting and running problems in the new vehicle and also by the formation of undesirable deposits in the fuel systems of the vehicles leading to longer term operability problems. The fuel so used must resist gum and sediment formation, minimize oxidation and prevent corrosion in the metallic portions of the fuel system as well as passivate fresh metal surfaces. Likewise, the fuel storage facilities, for example, tankage, pumps and plumbing, at the motor vehicle assembly site are also susceptible to the deposition of these unwanted solid materials from the quantities of stored motor fuels awaiting transfer to the newly assembled vehicles.

The desired storage stability of the fuel is usually attained through the addition of appropriate additives to the fresh fuel. Typically, complex combinations of antioxidants, such as aromatic diamines or hindered phenols, carboxylic acid-based corrosion inhibitors, and metallic ion sequesterants such as salicylidene diamines are added as a stability-inducing additive to the fuel.

Whether used alone or as part of a fuel stability additive mixture, there is need for corrosion inhibitors adapted for use in oxygenated gasolines that would retain effectiveness over a long period of time.

It has also been found that the carboxylic acid functionality present in certain corrosion inhibitors has a deleterious effect in some additive formulations. While the exact nature of these effects is difficult to determine, it appears that problems arise when the acidic corrosion inhibitor reacts with certain amine bases in additive formulations to form salts which precipitate from solution to form an undesirable sludge. Not only is the instant invention concerned with identifying long acting corrosion inhibitors for oxygenated gasolines, it is desirable to constrain the ratio of acid to amine functionalities in order to minimize undesirable sludge.

Many corrosion inhibitors are known. For example, U.S. Pat. No. 3,663,561 discloses 2-hydrocarbylthio-5-mercapto-1,3,4-thiadiazoles stated to be useful as sulfur scavengers.

U.S. Pat. No. 3,117,091 discloses as rust preventive compounds for a petroleum based carrier such as motor gasoline, aviation gasoline, jet fuel, turbine oils and the like, the partial esters of an alkyl or alkenyl succinic anhydride produced by the reaction of one molar equivalent of a polyhydric alcohol with two molar equivalents of the anhydride.

U.S. Pat. No. 4,128,403 discloses a fuel additive having improved rust-inhibiting properties comprising (1) from 5 to 50 weight percent of a hydrocarbyl amine containing at least 1 hydrocarbyl group having a molecular weight between about 300 and 5000, (2) from 0.1 to 10 weight percent of a C12 to C30 hydrocarbyl succinic acid or anhydride, (3) from 0.1 to 10 weight percent of a demulsifier, and (4) 40 to 90 weight percent of an inert hydrocarbon solvent.

U.S. Pat. No. 4,148,605 discloses novel dicarboxylic ester-acids resulting from the condensation of an alkenylsuccinic anhydride with an aliphatic hydroxy acid having from 2 to about 18 carbon atoms and amine salts of said ester-acid as rust or corrosion inhibitors in organic compositions.

U.S. Pat. No. 4,214,876 discloses improved corrosion inhibitor compositions for hydrocarbon fuels consisting of mixtures of (a) about 75 to 95 weight percent of a polymerized unsaturated aliphatic monocarboxylic acid having about 16 to 18 carbons, and (b) about 5 to 25 weight percent of a monoalkenylsuccinic acid wherein the alkenyl group has 8 to 18 carbons.

U.S. Pat. No. 5,035,720 relates to a corrosion inhibiting composition comprising an oil-soluble adduct of a triazole and a basic nitrogen compound.

U.S. Pat. No. 5,080,686 relates to the use of alkyl or alkenyl succinic acids to inhibit the corrosion of metals in oxygenated fuel systems.

US 2008/0216393 relates to compositions and methods for reducing corrosion and improving durability in engines combusting a fuel containing ethanol and a corrosion inhibitor.

It would be desirable to have long acting corrosion inhibitor or mixtures thereof at low treat rates which would protect fuel distribution infrastructure and internal combustion engines when exposed to a variety of oxygenated fuels, including specifically gasoline blends comprising biologically-derived butanol, under different conditions, and which would not produce high levels of insolubles or cause valve or injector sticking in engines but comprise increased renewable content as compared to other oxygenated gasoline blends.

SUMMARY OF THE INVENTION

This invention relates to an oxygenated gasoline composition having improved corrosion properties comprising a gasoline blend stock; about 1 to about 85 v/v % oxygenate or mixtures thereof, and an amount of one or more corrosion inhibitor wherein the amount of corrosion inhibitor is about or 3.00 to about 50 ptb of gasoline blend and the composition has acid/amine eq/eq ratio ranging from about 1.00 to about 3.00. The oxygenate may include butanol, and specifically biologically-derived butanol, isomers thereof, or blends of biological derived alcohols, such as biobutanol and bioethanol (bioethanol and biobutanol refer to biologically-derived alcohols in which the alcohols are produced by fermentation or other biological production).

This invention also relates to an oxygenated gasoline composition having improved corrosion properties comprising a gasoline blend stock, about 1 to about 85 v/v % oxygenate or mixtures thereof, and an amount of one or more corrosion inhibitor wherein the amount of corrosion inhibitor is about or 1 to about 50 ptb of gasoline blend and wherein said one or more corrosion inhibitors have an acid/amine equivalence ratio of about 1.00 to about 3.00.

In some embodiments, the one or more corrosion inhibitors is selected from the group consisting of at least one dimer acid, at least one trimer acid, and mixtures thereof; said dimer and trimer acid resulting from the dimerization or trimerization respectively of unsaturated fatty acids. In some embodiments, the one or more corrosion inhibitors comprise at least one alkyl or alkenyl carboxylic acid. In some embodiments, said alkyl or alkenyl carboxylic acid is an alkenyl succinic acid.

In some embodiments, the one or more corrosion inhibitors comprise at least one isoaliphatic acid having a principal saturated aliphatic chain typically having from about 6 to about 20 carbon atoms and at least one acyclic lower alkyl groups.

In some embodiments, the one or more corrosion inhibitors comprise at least one addition product of an unsaturated fatty acid with one or more unsaturated carboxylic reagents. In some embodiments, the unsaturated fatty acid is selected from the group consisting of tall oil fatty acid and oleic acid.

In some embodiments, the one or more corrosion inhibitors comprise at least one tricarboxylic acid. In some embodiments, the tricarboxylic acid is a trimer acid, or one or more reaction products of an unsaturated fatty acid and an alpha beta unsaturated dicarboxylic acid, or mixtures thereof. In some embodiments, the tricarboxylic acid or its derivative is the reaction product of an alkenyl succinic anhydride and an alpha beta unsaturated dicarboxylic acid, or functional derivatives thereof. In some embodiments, the alpha beta unsaturated dicarboxylic acid is selected from the group consisting of maleic acid, fumaric acid, mesaconic acid, itaconic acid, citraconic acid, and functional derivatives thereof.

In some embodiments, the one or more corrosion inhibitors comprise at least one reaction product of one or more olefins or polyalkenes with an alpha beta unsaturated dicarboxylic acid. In some embodiments, the one or more olefins is selected from the group consisting of 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, and 1-tetracosene. In some embodiments, the one or more olefins is selected from the group consisting of C15-18 alpha-olefins, C12-C16 alpha-olefins, C14-16 alpha-olefins, C14-18 alpha-olefins, C16-18 alpha-olefins, C16-20 alpha-olefins, C18-24 alpha-olefins, and C22-28 alpha-olefins. In some embodiments, the alpha beta unsaturated dicarboxylic acid is selected from the group consisting of maleic acid, fumaric acid, mesaconic acid, itaconic acid, citraconic acid, and functional derivatives thereof. In some embodiments, the reaction product is dodecenyl succinic acid.

In some embodiments, the one or more corrosion inhibitors comprise at least one reaction product of at least one dimer acid with at least one amine. In some embodiments, the one or more corrosion inhibitors comprise at least one reaction product of at least one trimer acid with at least one amine. In some embodiments, the one or more corrosion inhibitors comprise at least one reaction product of at least one alkyl or alkenyl carboxylic acid with at least one amine. In some embodiments, the one or more corrosion inhibitors comprise at least one reaction product of at least one isoaliphatic acid having a principal saturated aliphatic chain having from about 6 to about 20 carbon atoms and at least one acyclic lower alkyl groups with at least one amine.

In some embodiments, the one or more corrosion inhibitors comprise at least one addition product of an unsaturated fatty acid with one or more unsaturated carboxylic reagents, with at least one amine. In some embodiments, the unsaturated fatty acid is selected from the group consisting of tall oil fatty acid and oleic acid.

In some embodiments, the one or more corrosion inhibitors comprise at least one tricarboxylic acid and at least one amine. In some embodiments, the tricarboxylic acid is a trimer acid, or one or more reaction products of an unsaturated fatty acid and an alpha beta unsaturated dicarboxylic acid, or mixtures thereof. In some embodiments, the tricarboxylic acid or its derivative is one or more reaction products of an alkenyl succinic anhydride and an alpha, beta unsaturated dicarboxylic acid, or functional derivatives thereof. In some embodiments, the alpha beta unsaturated dicarboxylic acid is selected from the group consisting of maleic acid, fumaric acid, mesaconic acid, itaconic acid, citraconic acid, and functional derivatives thereof.

In some embodiments, the amine is a fatty amine. In some embodiments, the fatty amine is at least one selected from the group consisting of n-octylamine, n-decylamine, n-dodecylamine, n-tetradecylamine, n-hexadecylamine, n-octadecylamine, stearylamine, oleyamine, tallowamine, cocoamine, and soyaamine.

In some embodiments, the amine is a primary ether amine. In some embodiments, the primary ether amine is represented by the formula, $R_1(OR_2)_n—NH_2$, wherein $R_1$ is a hydrocarbyl group from about 1 to about 20 carbon atoms, $R_2$ is a divalent alkylene group having about 2 to about 6 carbon atoms; and n is a number from one to about 10. In some embodiments, the primary ether amine is at least one selected from the group consisting of decyloxypropylamine, linear C-16 etheramine, and tridecyloxypropylamine, isohexyloxypropylamine, 2-ethylhexyloxypropylamine, octyl/decyloxypropylamine, isodecyloxypropylamine, isododecyloxypropylamine, isotridecyloxypropylamine, and C12-15 alkyloxypropylamine.

In some embodiments, the amine is a tertiary alkyl primary amine represented by the formula $(R_1)_3C—NH_2$ wherein $R_1$ are independent hydrocarbyl groups containing from 1 to about 24 carbon atoms, or the formula $R_1—C(R_2)—NH_2$ wherein $R_1$ is an hydrocarbyl group containing from 1 to about 24 carbon atoms and $R_2$ is a divalent hydrocarbylene group, containing from 1 to about 12 carbon atoms. In some embodiments, $R_2$ is an alkylene group. In some embodiments, the amine is at least one selected from the group consisting of tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracos anylamine, and tert-octacosanylamine.

In some embodiments, the amine is represented by the formula $R_1—NH—(CH)_n—NH_2$, wherein $R_1$ is a hydrocarbyl group containing from 1 to about 24 carbon atoms and n is from 1 to about 20.

In some embodiments, the amine is at least one selected from the group consisting of dicyclohexylamine and N,N-dimethylcyclohexylamine.

In some embodiments, the amine is a polyamine. In some embodiments, the polyamine is a fatty diamine. In some embodiments, the fatty diamine is at least one selected from the group consisting of N-octyl diaminoalkanes, N-decyl diaminoalkanes, N-dodecyl diaminoalkanes, N-tetradecyl diaminoalkanes, N-hexadecyl diaminoalkanes, N-octadecyl diaminoalkanes, N-stearyl diaminoalkanes, N-oleyl diaminoalkanes, N-tallow diaminoalkanes, N-cocoyl diaminoalkanes, and N-soya diaminoalkanes. In some embodiments, the fatty diamine is at least one selected from the group consisting of N-coco-1,3-diaminopropane, N-soya-1,3-diaminopropane, N-tallow-1,3-diaminopropane, and N-oleyl-1,3-diaminopropane. In some embodiments, the polyamine is at least one selected from the group consisting of polyoxyalkylene diamine and polyoxyalkylene triamine. In some embodiments, the polyamine is at least one hydroxy-containing polyamine selected from the group consisting of N-(2-hydroxyethyl)ethylenediamine, N,N'-bis(2-hydroxyethyl)ethylenediamine, 1-(2-hydroxyethyl)piperazine, mono(hydroxypropyl)-substituted tetraethylenepentamine, and N-(3-hydroxybutyl)tetramethylenediamine.

In some embodiments, the polyamine is at least one alkylenepolyamine selected from the group consisting of methylenepolyamines, ethylenepolyamines, butylenepolyamines, propylenepolyamines, pentylenepolyamines, piperazines and N-(amino alkyl)-substituted piperazines. In some embodiments, the alkylenepolyamine is selected from the group consisting of ethylenediamine, triethylenetetramine, tris-(2-aminoethyl)amine, propylenediamine, trimethylenediamine, tripropylenetetramine, triethylenetetraamine, tetraethylenepentamine, hexaethyleneheptamine, and pentaethylenehexamine. In some embodiments, the polyamine is one or more polyhydric amines selected from the group consisting of diethanolamine, triethanolamine, tri-(hydroxypropyl) amine, tris-(hydroxymethyl)amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine.

In some embodiments, the amine is at least one ether diamine represented by the formula $NH_2(CH_2)_n$—NH—$(CH_2)_m$—O—R, where n and m are independently 1 to about 10 and R is C1-C18. In some embodiments, the ether diamine is represented by the formula ROCH2CH2CH2NHCH2CH2CH2NH2 where R is C3-C18. In some embodiments, the ether diamine is selected from the group consisting of isodecyloxypropyl-1,3-diaminopropane, isododecyloxypropyl-1,3-diaminopropane, and isotridecyloxypropyl-1,3-diaminopropane.

In some embodiments, the one or more corrosion inhibitors comprise a fatty amine. In some embodiments, fatty amine is at least one selected from the group consisting of n-octylamine, n-decylamine, n-dodecylamine, n-tetradecylamine, n-hexadecylamine, n-octadecylamine, stearylamine, oleyamine, tallowamine, cocoamine, and soyaamine.

In some embodiments, one or more corrosion inhibitors comprise a primary ether amine. In some embodiments, the primary ether amine is represented by the formula $R_1(OR_2)_n$—$NH_2$, wherein $R_1$ is a hydrocarbyl group from about 1 to about 20 carbon atoms, $R_2$ is a divalent alkylene group having about 2 to about 6 carbon atoms; and n is a number from one to about 10. In some embodiments, the primary ether amine is at least one selected from the group consisting of decyloxypropylamine, linear C-16 etheramine, and tridecyloxypropylamine, isohexyloxypropylamine, 2-ethylhexyloxypropylamine, octyl/decyloxypropylamine, isodecyloxypropylamine, isododecyloxypropylamine, isotridecyloxypropylamine, and C12-15 alkyloxypropylamine.

In some embodiments, the one or more corrosion inhibitors comprise a tertiary alkyl primary amine represented by the formula $(R_1)_3C$—$NH_2$ wherein $R_1$ are independent hydrocarbyl groups containing from 1 to about 24 carbon atoms, or the formula $R_1$—C($R_2$)—$NH_2$ wherein $R_1$ is an hydrocarbyl group containing from 1 to about 24 carbon atoms and $R_2$ is a divalent hydrocarbylene group, containing from 1 to about 12 carbon atoms. In some embodiments, R2 is an alkylene group. In some embodiments, the tertiary alkyl primary amine is at least one selected from the group consisting of tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracos anylamine, and tert-octacosanylamine.

In some embodiments, the one or more corrosion inhibitors comprise at least one amine represented by the formula $R_1$—NH—$(CH)_n$—$NH_2$, wherein $R_1$ is a hydrocarbyl group containing from 1 to about 24 carbon atoms and n is from 1 to about 20.

In some embodiments, the one or more corrosion inhibitors comprise at least one polyamine. In some embodiments, the polyamine is a fatty diamine. In some embodiments, the fatty diamine is at least one selected from the group consisting of N-octyl diaminoalkanes, N-decyl diaminoalkanes, N-dodecyl diaminoalkanes, N-tetradecyl diaminoalkanes, N-hexadecyl diaminoalkanes, N-octadecyl diaminoalkanes, N-stearyl diaminoalkanes, N-oleyl diaminoalkanes, N-tallow diaminoalkanes, N-cocoyl diaminoalkanes, and N-soya diaminoalkanes. In some embodiments, the fatty diamine is at least one selected from the group consisting of N-coco-1,3-diaminopropane, N-soya-1,3-diaminopropane, N-tallow-1,3-diaminopropane, and N-oleyl-1,3-diaminopropane. In some embodiments, the polyamine is at least one selected from the group consisting of polyoxyalkylene diamine and polyoxyalkylene triamine. In some embodiments, the polyamine is at least one hydroxy-containing polyamine selected from the group consisting of N-(2-hydroxyethyl) ethylenediamine, N,N'-bis(2-hydroxyethyl)ethylenediamine, 1-(2-hydroxyethyl)piperazine, mono(hydroxypropyl)-substituted tetraethylene-pentamine, and N-(3-hydroxybutyl)tetramethylenediamine. In some embodiments, the polyamine is at least one alkylenepolyamine selected from the group consisting of methylenepolyamines, ethylenepolyamines, butylenepolyamines, propylenepolyamines, pentylenepolyamines, piperazines and N-amino alkyl-substituted piperazines. In some embodiments, the alkylenepolyamine is selected from the group consisting of ethylenediamine, triethylenetetramine, tris-(2-aminoethyl)amine, propylenediamine, trimethylenediamine, tripropylenetetramine, triethylenetetraamine, tetraethylenepentamine, hexaethyleneheptamine, and pentaethylenehexamine. In some embodiments, the polyamine is at least one polyhydric amine selected from the group consisting of diethanolamine, triethanolamine, tri-(hydroxypropyl)amine, tris-(hydroxymethyl)amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine.

In some embodiments, the one or more corrosion inhibitors comprise at least one ether diamine represented by the formula $NH_2(CH_2)$n-NH—$(CH_2)$m-O—R, where n and m are independently 1 to about 10 and R is C1-C18. In some embodiments, the ether diamine is represented by the formula ROCH2CH2CH2NHCH2CH2CH2NH2 where R is C3-C18. In some embodiments, the ether diamine is selected from the group consisting of isodecyloxypropyl-1,3-diaminopropane, isododecyloxypropyl-1,3-diaminopropane, and isotridecyloxypropyl-1,3-diaminopropane.

In some embodiments, the one or more corrosion inhibitors comprise at least one amide formed by the reaction of unsaturated fatty acid and N-methyl glycine. In some embodiments, the amide is N-methyl-N-(1-oxo-9-octadecenyl)glycine.

In some embodiments, the one or more corrosion inhibitors comprise at least one reaction product of linoleic acid or tall oil fatty acid with acrylic acid. In some embodiments, the reaction product is 5-carboxy-4-hexyl-2-cyclohexene-1-octanoic acid, or 6-carboxy-4-hexyl-2-cyclohexene-1-octanoic acid.

In some embodiments, the one or more corrosion inhibitors comprise at least one reaction product of unsaturated fatty acid and N-(2-hydroxyethyl)-1,2-diaminoethane. In some embodiments, the reaction product is 1-(2-hydroxyethyl)-2-(8-heptadecenyl)-2-imidazoline.

In some embodiments, the fatty acid is present as a byproduct of the processing of feedstock for the production of biologically-derived oxygenate. In some embodiments, the fatty acid is present as extractant for recoverying the biologically-derived oxygenate from a fermentation broth. In some embodiments, the oxygenate is isobutanol. In some embodiments, the fatty acid is derived from corn oil. In some embodiments, the extractant is corn oil fatty acid or oleic acid.

In some embodiments, the oxygenated gasoline composition comprises two or more, three or more, or four or more corrosion inhibitors.

In some embodiments, the at least one oxygenate or mixtures thereof is selected from the group consisting of methanol, ethanol, propanol, butanol, pentanol, hexanol, heptanol, octanol, ketones, esters and mixtures thereof. In some embodiments, the composition comprises no more than about 5 v/v % methanol. In some embodiments, the composition comprises no more than about 10 v/v % ethanol. In some embodiments, the composition comprises no more than about 20 v/v % ethanol. In some embodiments, the composition comprises no more than about 30 v/v % ethanol. In some embodiments, the composition comprises no more than about 10 v/v % butanol. In some embodiments, the composition comprises no more than about 20 v/v % butanol. In some embodiments, the composition comprises no more than about 30 v/v % butanol. In some embodiments, the composition comprises no more than about 40 v/v % butanol. In some embodiments, the composition comprises about 16 v/v % isobutanol. In some embodiments, the composition comprises about 24 v/v % isobutanol. In some embodiments, the composition comprises about 5-65 v/v % by volume of ethanol and about 5 to 50 v/v % butanol. In some embodiments, said oxygenate comprises at least about 5% renewable component. In some embodiments, said renewable component comprises biologically-derived ethanol, biologically-derived butanol or mixtures thereof. In some embodiments, the oxygenated gasoline composition further comprises one or more deposit control additives.

This invention also relates to an additive concentrate suitable for blending with oxygenated gasoline comprising about 1 to about 85 v/v % oxygenate or mixtures thereof, to provide corrosion protection in internal combustion engines and fuel infrastructure systems, wherein the additive concentrate comprises a solvent and from 10 wt % to 50 wt % based on solvent of at least one corrosion inhibitor. In some embodiments, the solvent is an organic solvent, lubricating oil basestock or mixture thereof.

Another embodiment of the invention relates to a method for reducing corrosion in an internal combustion engine and fuel infrastructure systems comprising operating the internal combustion engine or the fuel infrastructure system with a fuel composition comprising a gasoline blend stock, about 1 to about 85 v/v % oxygenate, and at least one corrosion inhibitor wherein the total corrosion inhibitor concentration is about 3.00 to about 50 ptb and the composition has acid/amine eq/eq ratio ranging from about 1.00 to about 3.00.

Another aspect of the invention provides a method of reducing corrosion in an internal combustion engine and fuel infrastructure systems comprising operating the internal combustion engine or the fuel infrastructure system with a fuel composition comprising a fuel blend stock, about 1 to about 85 v/v % oxygenate, and one or more corrosion inhibitors in an amount of from about 1.0 to about 50 ptb and wherein said one or more corrosion inhibitors have an acid/amine equivalence ratio of about 0.1 to about 3.

Another aspect of the invention provides oxygenated gasoline for use in internal combustion engines comprising a gasoline blend stock, about 1 to about 85 v/v % oxygenate or mixtures thereof, and at least two corrosion inhibitors wherein the total corrosion inhibitor concentration is about or 3.00 to about 50 ptb of gasoline blend and the composition has acid/amine eq/eq ratio ranging from about 1.00 to about 3.00.

It is yet another aspect of the invention to provide a method for conferring corrosion inhibiting properties to oxygenated gasoline blends comprising a gasoline blend stock and about 1 to about 85 v/v % oxygenate or mixtures thereof; said method comprising blending said gasoline and oxygenate with at least two corrosion inhibitors wherein the total corrosion inhibitor concentration is about 3.00 to about 50 ptb and the composition has acid/amine eq/eq ratio ranging from about 1.00 to about 3.00.

Another aspect of the invention is a method of manufacturing the corrosion inhibited oxygenated gasoline composition comprising adding the at least one corrosion inhibitor to an oxygenate—gasoline blend stock. In some embodiments, the oxygenate-gasoline blend stock comprises methanol, ethanol, butanol, or mixtures thereof. In some embodiments, the butanol is blended with one or more gasoline blend stocks and optionally with one or more suitable oxygenates. In some embodiments, the one or more gasoline blend stocks, butanol, and optionally one or more suitable oxygenates can be blended in any order. In some embodiments, the one or more suitable oxygenates and a butanol isomer can be added in several different locations or in multiple stages. In some embodiments, the one or more butanol and optionally one or more suitable oxygenates can be added at any point within the distribution chain. In some embodiments, the one or more gasoline blending stocks, one or more butanol isomers and optionally one or more suitable oxygenates can be combined at a refinery. In some embodiments, other components or additives can also be added to the gasoline composition at a refinery, terminal, retail site, or any other suitable point in the distribution chain.

It is yet another aspect of the invention to provide a method of improving the storage stability of an oxygenated fuel composition comprising adding to a fuel blend stock having about 1 to about 85 v/v % oxygenate, one or more deposit control additives and one or more corrosion inhibitors in an amount of from about 3.00 to about 50 ptb and wherein said one or more corrosion inhibitors have an acid/amine equivalence ratio of about 1.00 to about 3.00.

It is yet another aspect of the invention to provide a method of improving the storage stability of an oxygenated fuel composition comprising adding to a fuel blend stock having about 1 to about 85 v/v % oxygenate, one or more deposit control additives and one or more corrosion inhibitors in an amount of from about 1.0 to about 50 ptb and wherein said one or more corrosion inhibitors have an acid/amine equivalence ratio of about 0.1 to about 3. In some embodiments, the corrosion protection and storage stability of the oxygenated gasoline composition is maintained for at least 12 weeks.

Another aspect of the invention is a storage stable isobutanol composition comprising isobutanol and one or more corrosion inhibitors.

It is yet another aspect of the invention to provide an oxygenated gasoline composition having improved corrosion properties comprising a gasoline blend stock, about 1 to about 85 v/v % oxygenate or mixtures thereof, and an amount of one or more corrosion inhibitors wherein said amount is about 0.5 ptb to about 5 ptb and wherein one or more corrosion inhibitors have an acid:amine equivalence ratio of about 1:10 to about 1:0. In some embodiments, one or more corrosion inhibitors have an acid:amine equivalence ratio of about 1:9. In some embodiments, one or more corrosion inhibitors have an acid:amine equivalence ratio of about 1:0.

In some embodiments, one or more corrosion inhibitors have a nitrogen content of less than about 100 ppm. In some embodiments, one or more corrosion inhibitors have a nitrogen content of less than about 70 ppm. In some embodiments, one or more corrosion inhibitors have a nitrogen content of less than about 50 ppm. In some embodiments, one or more corrosion inhibitors have no detectable amine.

In some embodiments, one or more corrosion inhibitors comprise at least one alkyl or alkenyl carboxylic acid. In some embodiments, said alkenyl carboxylic acid is tetrapropenylsuccinic acid. In some embodiments, the one or more corrosion inhibitors comprise about 25 to about 75 wt/wt % of said alkyl or alkenyl carboxylic acid. In some embodiments, the one or more corrosion inhibitors comprise about 30 to about 70 wt/wt % of said alkyl or alkenyl carboxylic acid. In some embodiments, the one or more corrosion inhibitors comprise about 30 to about 60 wt/wt % of tetrapropenylsuccinic acid. In some embodiments, the one or more corrosion inhibitors comprise about 60 to about 70 wt/wt % of a carboxylic acid ester or functional derivative thereof. In some embodiments, the one or more corrosion inhibitors further comprise a solvent comprising xylenes and ethyl benzene. In some embodiments, the one or more corrosion inhibitors comprise about 1 to about 15 wt/wt % of said alkyl or alkenyl carboxylic acid. In some embodiments, the one or more corrosion inhibitors comprise about 5 to about 10 wt/wt % of said alkyl or alkenyl carboxylic acid. In some embodiments, the one or more corrosion inhibitors further comprise about 50 to about 100 wt/wt % of at least one amine. In some embodiments, the one or more corrosion inhibitors further comprise about 60 to about 100 wt/wt % of at least one alkyl amine.

In some embodiments, said amount of one or more corrosion inhibitors is about 1 ptb to about 4 ptb. In some embodiments, said amount of one or more corrosion inhibitors is about 1 ptb to about 2 ptb. In some embodiments, said amount of one or more corrosion inhibitors is about 1.6 ptb. In some embodiments, said amount of one or more corrosion inhibitors is about 3 ptb to about 5 ptb. In some embodiments, said amount of one or more corrosion inhibitors is about 4 ptb.

In some embodiments, the at least one oxygenate or mixtures thereof is selected from the group consisting of methanol, ethanol, propanol, butanol, pentanol, hexanol, heptanol, octanol, ketones, esters and mixtures thereof. In some embodiments, the composition comprises no more than about 5 v/v % methanol. In some embodiments, the composition comprises no more than about 10 v/v % ethanol. In some embodiments, the composition comprises no more than about 20 v/v % ethanol. In some embodiments, the composition comprises no more than about 30 v/v % ethanol. In some embodiments, the composition comprises no more than about 10 v/v % butanol. In some embodiments, the composition comprises no more than about 20 v/v % butanol. In some embodiments, the composition comprises no more than about 30 v/v % butanol. In some embodiments, the composition comprises no more than about 40 v/v % butanol. In some embodiments, the composition comprises about 16 v/v % isobutanol. In some embodiments, the composition comprises about 24 v/v % isobutanol. In some embodiments, the composition comprises about 5-65 v/v % by volume of ethanol and about 5 to 50 v/v % butanol.

Another aspect of the invention is to provide a method of reducing corrosion in an internal combustion engine and fuel infrastructure systems comprising operating the internal combustion engine or the fuel infrastructure system with a fuel composition comprising a fuel blend stock, about 1 to about 85 v/v % oxygenate or mixtures thereof, and an amount of one or more corrosion inhibitors wherein said amount is about 0.5 ptb to about 5 ptb and wherein one or more corrosion inhibitors have an acid:amine equivalence ratio of about 1:10 to about 1:0.

It is yet another aspect of the invention to provide a method of manufacturing the corrosion inhibited oxygenated gasoline composition comprising adding the at least one corrosion inhibitor to an oxygenate—gasoline blend stock.

Another aspect of the invention is to provide a method of improving the storage stability of an oxygenated fuel composition comprising adding to a fuel blend stock having about 1 to about 85 v/v % oxygenate, one or more deposit control additives and one or more corrosion inhibitors in an amount of from about 0.5 to about 5 ptb and wherein one or more corrosion inhibitors have an acid:amine equivalence ratio of about 1:10 to about 1:0. In some embodiments, corrosion protection and storage stability of the oxygenated fuel composition is maintained for at least 12 weeks.

It is yet another aspect of the invention to provide a storage stable isobutanol composition comprising the oxygenated gasoline composition wherein the oxygenate is isobutanol.

Another aspect of the invention is to provide a corrosion inhibited oxygenate comprising about 90 to about 100 wt/wt % of an alcohol and about 10 to about 200 ptb of a corrosion inhibitor, wherein the corrosion inhibitor has an acid:amine equivalence ratio of about 1:10 to about 1:0. In some embodiments, the alcohol is biologically derived. In some embodiments, the alcohol is selected from the group consisting of methanol, ethanol, propanol, butanol, isobutanol, pentanol, hexanol, heptanol, octanol, and mixtures thereof.

It is yet another aspect of the invention to provide a method of manufacturing for oxygenated gasoline comprising blending the corrosion inhibited oxygenate with gasoline base stock to make oxygenated gasoline. In some embodiments, the corrosion inhibited oxygenate comprises an alcohol that is biologically derived. In some embodiments, the alcohol is selected from the group consisting of methanol, ethanol, propanol, butanol, isobutanol, pentanol, hexanol, heptanol, octanol, and mixtures thereof.

In some embodiments, the invention provides an oxygenated gasoline composition comprising one or more corrosion inhibitors and about 1 to about 30 v/v % of a biologically-derived alcohol. In some embodiments, the alcohol is selected from the group consisting of methanol, ethanol, propanol, butanol, isobutanol, pentanol, hexanol, heptanol, octanol, and mixtures thereof. In some embodiments, the concentration of the corrosion inhibitor is about 0.5 ptb to about 5 ptb. In some embodiments, the one or more corrosion inhibitors have an acid:amine equivalence ratio of about 0.1 to about 3. In some embodiments, the one or more corrosion inhibitors have an acid:amine equivalence ratio of about 1:10 to about 1:0.

It is to be understood that both the foregoing general description and the following detailed description are exemplary and explanatory only and are intended to provide further explanation of the present disclosure, as claimed.

DETAILED DESCRIPTION OF THE INVENTION

The oxygenated gasoline corrosion inhibitors of the present invention are intended for use in fuels (primarily automotive fuels) containing up to 85 volume percent oxygenate, preferably from about 2 to about 50 volume percent, and most preferably from about 5 to about 30 volume percent of at least one alcohol. The alcohol can be one or a mixture of methanol, ethanol, propyl or butanol and preferably is isobutanol. Where the alcohol is isobutanol, the volume percent of oxygenate may be 2, 4, 5, 6, 8, 10, 11, 12, 16, 20, 24 (and any integers in between) volume percent. The oxygenated gasolines of the present invention are intended for use as a spark ignition engine fuel.

Unless defined otherwise, all technical and scientific terms used herein have the same meaning as commonly understood by one of ordinary skill in the art to which this invention belongs. In the case of a conflict, the present application including the definitions will control. Also, unless otherwise required by context, singular terms shall include pluralities and plural terms shall include the singular. All publications, patents and other references mentioned herein are incorporated by reference in their entireties for all purposes.

In order to further define this invention, the following terms and definitions are herein provided.

As used herein, the terms "comprises," "comprising," "includes," "including," "has," "having," "contains" or "containing," or any other variation thereof, will be understood to imply the inclusion of a stated integer or group of integers but not the exclusion of any other integer or group of integers. For example, a composition, a mixture, a process, a method, an article, or an apparatus that comprises a list of elements is not necessarily limited to only those elements but may include other elements not expressly listed or inherent to such composition, mixture, process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

As used herein, the term "consists of," or variations such as "consist of" or "consisting of," as used throughout the specification and claims, indicate the inclusion of any recited integer or group of integers, but that no additional integer or group of integers may be added to the specified method, structure, or composition.

As used herein, the term "consists essentially of," or variations such as "consist essentially of" or "consisting essentially of," as used throughout the specification and claims, indicate the inclusion of any recited integer or group of integers, and the optional inclusion of any recited integer or group of integers that do not materially change the basic or novel properties of the specified method, structure or composition.

Also, the indefinite articles "a" and "an" preceding an element or component of the invention are intended to be nonrestrictive regarding the number of instances, i.e., occurrences of the element or component. Therefore "a" or "an" should be read to include one or at least one, and the singular word form of the element or component also includes the plural unless the number is obviously meant to be singular.

The terms "invention" or "present invention" as used herein is a non-limiting term and is not intended to refer to any single embodiment of the particular invention but encompasses all possible embodiments as described in the application.

As used herein, the term "about" modifying the quantity of an ingredient or reactant of the invention employed refers to variation in the numerical quantity that can occur, for example, through typical measuring and liquid handling procedures used for making concentrates or solutions in the real world; through inadvertent error in these procedures; through differences in the manufacture, source, or purity of the ingredients employed to make the compositions or to carry out the methods; and the like. The term "about" also encompasses amounts that differ due to different equilibrium conditions for a composition resulting from a particular initial mixture. Whether or not modified by the term "about", the claims include equivalents to the quantities. In one embodiment, the term "about" means within 10% of the reported numerical value; in another embodiment, within 5% of the reported numerical value.

The term "alcohol" as used herein refers to any of a series of hydroxyl compounds, the simplest of which are derived from saturated hydrocarbons, having the general formula $C_nH_{2n+1}OH$. Examples of alcohol include methanol, ethanol and butanol.

"Butanol" as used herein refers with specificity to the butanol isomers 1-butanol (1-BuOH), 2-butanol (2-BuOH), tert-butanol (t-BuOH), and/or isobutanol (iBuOH or i-BuOH or I-BUOH, also known as 2-methyl-1-propanol), either individually or as mixtures thereof. From time to time, when referring to esters of butanol, the terms "butyl esters" and "butanol esters" may be used interchangeably. The butanol can be biologically-derived (i.e., biobutanol), for example. Biologically-derived and biologically-sourced are used interchangeably refers to fermentative (or some other biological) production. See, e.g., U.S. Pat. No. 7,851,188, herein incorporated by reference in its entirety.

The terms "renewable component" as used herein, refers to a component that is not derived from petroleum or petroleum products.

The term "fuel" as used herein, refers to any material that can be used to generate energy to produce mechanical work in a controlled manner. Examples of fuels include, but are not limited to, biofuels (i.e., fuels which are in some way derived from biomass), gasoline, gasoline subgrades, diesel and jet fuel. It is understood that the specific components and allowances of suitable fuels can vary based on seasonal and regional guidelines.

The terms "fuel blend" or "blended fuel" as used herein, refer to a mixture containing at least a fuel and one or more alcohols.

The term "gasoline" as used herein, generally refers to a volatile mixture of liquid hydrocarbons that can optionally contain small amounts of additives. This term includes, but is not limited to, conventional gasoline, oxygenated gasoline, reformulated gasoline, biogasoline (i.e., gasoline which in some way is biologically-derived from biomass), and Fischer-Tropsch gasoline, and mixtures thereof. Additionally, the term "gasoline" includes a gasoline blend, gasoline blends, blended gasoline, a gasoline blend stock, gasoline blend stocks, and mixtures thereof. It is understood that the specific components and allowances of suitable gasolines can vary based on seasonal and regional guidelines. For example, standards for gasolines for sale within much of the United States are generally set forth in ASTM Standard Specification Number D 4814 ("ASTM D 4814") which is incorporated herein by reference. Standards for gasolines for sale within much of Europe are generally set forth in European Standard EN228:2008, which is also incorporated herein by reference. Additional federal and state regulations supplement this ASTM standard. The specifications for gasolines set forth in ASTM D 4814 vary based on a number of parameters affecting volatility and combustion such as weather, season, geographic location and altitude.

The terms "gasoline blend" and "blended gasoline" as used herein, refer to a mixture containing at least a gasoline and/or gasoline subgrade and/or mixtures of one or more refinery gasoline blending components (e.g., alkylate, reformate, FCC naphthas, etc) and optionally, one or more alcohols. A gasoline blend includes, but is not limited to, an unleaded gasoline suitable for combustion in an automotive engine.

The terms "American Society for Testing and Materials" and "ASTM" as used herein, refer to the international standards organization that develops and publishes voluntary consensus technical standards for a wide range of materials, products, systems, and services, including fuels.

The term "corrosion" as used herein refers to any degradation, rusting, weakening, deterioration, softening, and the like of any surface, including engine surfaces or a part or component of an engine or an engine component or part due to exposure to, or combustion of, an oxygenate-containing fuel.

The term "corrosion inhibition" or "reducing corrosion" as used herein refers to any improvement in minimizing, reducing, eliminating, or preventing corrosion.

Corrosion inhibitors of the present invention comprise low molecular weight (i.e., <700) amines (mono-, di-, tri, and poly), amines, etheramines, imines, imidazolines, thiadiazoles, monocarboxylic acids, dicarboxylic acids, tricarboxylic acids, and esters and functional derivatives of mono-, di-, and tricarboxylic acids, dimers, trimers, p-phenylenediamine, N,N-dimethylcyclohexylamine and dicyclohexylamine, alkyl substituted succinic anhydrides and acids and mixtures thereof and salts thereof.

Corrosion inhibitors useful herein can also include or comprise tetrapropenylsuccinic acid or anhydride and polymers thereof, and dodecenyl succinic acid (DDSA) or anhydride and polymers thereof.

In some embodiments of the invention, one or more corrosion inhibitors comprise about 1 to about 85 wt/wt %, about 3 to about 85 wt/wt %, about 5 to about 85 wt/wt %, about 1 to about 15 wt/wt %, about 3 to about 13 wt/wt %, about 5 to about 10 wt/wt %, about 6 to about 9 wt/wt %, about 15 to about 85 wt/wt %, about 25 to about 75 wt/wt %, about 30 to about 70 wt/wt %, about 30 to about 60 wt/wt %, or about 60 to about 70 wt/wt % of an alkyl or alkenyl carboxylic acid, or ester or functional derivative thereof. In some embodiments, one or more corrosion inhibitors comprise about 30 to about 60 wt/wt % of tetrapropenylsuccinic acid. In some embodiments, one or more corrosion inhibitors comprise about 60 to about 70 wt/wt % of a carboxylic acid ester or functional derivative thereof.

BioTEC® 9881 (listed as Tec 9881 in Table 1) is an example of a commercially available corrosion inhibitor in accordance with the invention which is believed to contain about 60 to about 100 wt/wt % of alkyl amine, and about 5 to about 10 wt/wt % of a long chain carboxylic acid. BioTEC® 9881 is believed to have an acid:amine equivalence ratio of about 1:9, with a nitrogen content of about 6.9%. BioTEC® 9880 (listed as Tec 9880 in Table 1) is an example of a commercially available corrosion inhibitor in accordance with the invention that is believed to contain about 30 to about 60 wt/wt % of tetrapropenylsuccinic acid. BioTEC® 9880 is believed to have an acid:amine equivalence ratio of about 1:0, with a nitrogen content less than about 0.1%. Lubrizol® 541 (listed as Lubrizol LZ 541 in Table 1) is an example of a commercially available corrosion inhibitor in accordance with the invention that is believed to contain about 60 to about 70 wt/wt % of a carboxylic acid ester or functional derivative thereof. Lubrizol® 541 is believed to have an acid:amine equivalence ratio of about 1:0, with a nitrogen content of less than about 0.1%.

In one embodiment, the corrosion inhibitor is the product of combining an organic acid or dimer acid or trimer acid and an amine, diamine, or polyamine.

In one embodiment, the corrosion inhibitor is the product of combining an organic acid or dimer acid or trimer acid with a fatty amine. Fatty amines are those containing from about 8 to about 30, or from about 12 to about 24 carbon atoms. The fatty amines include n-octylamine, n-decylamine, n-dodecylamine, n-tetradecylamine, n-hexadecylamine, n-octadecylamine, stearylamine, oleyamine, tallowamine, cocoamine, soyaamine, etc. Also useful fatty amines include commercially available fatty amines such as "Armeen" amines (products available from Akzo Chemicals, Chicago, Ill.), such as Akzo's Armeen C, Armeen O, Armeen OL, Armeen T, Armeen HT, Armeen S and Armeen SD, wherein the letter designation relates to the fatty group, such as cocoa, oleyl, tallow, or stearyl groups.

Other useful amines include primary ether amines, such as those represented by the formula, $R_1(OR_2)n\text{-}NH_2$, wherein $R_1$ is a hydrocarbyl group from about 1 to about 20, or from 5 to about 18 carbon atoms, $R_2$ is a divalent alkylene group having about 2 to about 6 carbon atoms; and n is a number from one to about 10, or from about one to about five, or one. An example of an ether amine is available under the name SURFAM® amines produced and marketed by Mars Chemical Company, Atlanta, Ga. Etheramines include those identified as SURFAM P14B (decyloxypropylamine), SURFAM P16A (linear C16), SURFAM P17B (tridecyloxypropylamine) isohexyloxypropylamine, 2-ethylhexyloxypropylamine, octyl/decyloxypropylamine, isodecyloxypropylamine, isododecyloxypropylamine, isot idecyloxypropylamine, C12-15 alkyloxypropylamine.

Yet other useful amines include ether diamines represented by the formula $NH_2(CH_2)n\text{-}NH\text{—}(CH_2)m\text{-}O\text{—}R$, where n and m are independently 1 to about 10 and R is C1-C18. Preferred ether diamine is of the formula $ROCH_2CH_2CH_2NHCH_2CH_2CH_2NH_2$ where R is C3-C18, preferably C6 to C15 and include as examples isodecyloxypropyl-1,3-diaminopropane, isododecyloxypropyl-1,3-diaminopropane, isotridecyloxypropyl-1,3-di aminopropane.

The term "hydrocarbyl" as used herein means that the group concerned is primarily composed of hydrogen and carbon atoms and is bonded to the remainder of the molecule via a carbon atom, but does not exclude the presence of other atoms or groups in a proportion insufficient to detract from the substantially hydrocarbon characteristics of the group. The hydrocarbyl group is preferably composed of only hydrogen and carbon atoms. Advantageously, the hydrocarbyl group is an aliphatic group, preferably alkyl or alkylene group, especially alkyl groups, which may be linear or branched.

In another embodiment, the corrosion inhibitor is the product of combining an organic acid or dimer acid or trimer acid with a tertiary-aliphatic primary amine. Generally, the aliphatic group, and in one embodiment an alkyl group, contains from about 4 to about 30, or from about 6 to about 24, or from about 8 to about 22 carbon atoms. Usually the tertiary alkyl primary amines are monoamines represented by the formula $(R_1)_3C—NH_2$ wherein $R_1$ are independent hydrocarbyl groups containing from 1 to about 24 carbon atoms, or the formula $R_1—C(R_2)—NH_2$ wherein $R_1$ is an hydrocarbyl group containing from 1 to about 24 carbon atoms and $R_2$ is a divalent hydrocarbylene group, preferably an alkylene group, containing from 1 to about 12 carbon atoms. Such amines are illustrated by tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine.

In another embodiment, the corrosion inhibitor is the product of combining an organic acid or dimer acid or trimer acid with an amine represented by the formula $R_1—NH—(CH)_n—NH_2$, wherein $R_1$ is a hydrocarbyl group containing from 1 to about 24 carbon atoms and n is from 1 to about 20.

Mixtures of amines are also useful for the purposes of this invention. Illustrative of amine mixtures of this type are "Primene 81R" which is a mixture of C11-C14 tertiary alkyl primary amines and "Primene JM-T" which is a mixture of C18-C22 tertiary alkyl primary amines (both are available from The Dow Chemical Company). The tertiary alkyl primary amines and methods for their preparation are known to those of ordinary skill in the art. The tertiary alkyl primary amine useful for the purposes of this invention and methods for their preparation are described in U.S. Pat. No. 2,945,749, which is hereby incorporated by reference for its teaching in this regard.

In another embodiment, the corrosion inhibitor is a basic acylated amine. The basic acylated amine includes reaction products of one or more carboxylic acylating agent and one or more amine, preferably a polyamine. The basic acylated amines are prepared by reacting an excess of amine with the carboxylic acylating agent. In one embodiment, greater than one equivalent of amine is reacted with each equivalent of carboxylic group of the acylating agent. The equivalents of the amine is based on the number of nitrogen atoms in the amine. The equivalent weight of the carboxylic acylating agent is based on the number of carboxylic groups (e.g. COO), such as acids, lower esters, etc. in each acylating agent. In one embodiment, at least about 1.2, preferably at least about 1.4 equivalents of amine are reacted with each equivalent of carboxylic group of the acylating agent. Typically, up to about 8, or preferably up to about 6, or more preferably up to about 4 equivalents of amine are reacted with each equivalent of carboxylic group of the acylating agent.

In one embodiment, the carboxylic acylating agent is present insitu as a byproduct of the feedstock used to produce a biologically-derived oxygenate component or a byproduct of extractants used to extract the biologically-derived oxygenate from a fermentation broth.

In another embodiment, the corrosion inhibitor comprises at least one ether diamine represented by the formula $NH_2(CH_2)n-NH—(CH_2)m-O—R$, where n and m are independently 1 to about 10 and R is C1-C18. Preferred ether diamine is of the formula $ROCH_2CH_2CH_2NHCH_2CH_2CH_2NH_2$ where R is C3-C18, preferably C6 to C15 and include as examples isodecyloxypropyl-1,3-diaminopropane, isododecyloxypropyl-1,3-diaminopropane, isotridecyloxypropyl-1,3-diaminopropane.

The basic acylated amines are prepared from one or more amines and one or more carboxylic acylating agents. The carboxylic acylating agents include fatty acids, isoaliphatic acids, dimer acids, addition dicarboxylic acids, trimer acids, addition tricarboxylic acids, and hydrocarbyl substituted carboxylic acylating agents. In one embodiment, the carboxylic acylating agent is one of the above described unsaturated fatty acids. The fatty acids may also be the saturated analogs of the unsaturated fatty acids.

In another embodiment, the corrosion inhibitor of the present invention comprises isoaliphatic acids. Such acids contain a principal saturated, aliphatic chain typically having from about 6 to about 20 carbon atoms and at least one, but usually no more than about four, pendant acyclic lower alkyl groups. Specific examples of such isoaliphatic acids include 10-methyl-tetradecanoic acid, 3-ethyl-hexadecanoic acid, and 8-methyl-octadecanoic acid. The isoaliphatic acids include branched-chain acids prepared by oligomerization of commercial fatty acids, such as oleic, linoleic and tall oil fatty acids.

In another embodiment, the corrosion inhibitor of the present invention comprises dimer acids. The dimer acids include products resulting from the dimerization of unsaturated fatty acids and generally contain an average from about 18 to about 44, or from about 28 to about 40 carbon atoms. Dimer acids are described in U.S. Pat. Nos. 2,482,760, 2,482,761, 2,731,481, 2,793,219, 2,964,545, 2,978,468, 3,157,681, and 3,256,304, the entire disclosures of which are incorporated herein by reference.

In another embodiment, the corrosion inhibitor of the present invention comprises addition carboxylic acids, which are addition (4+2 and 2+2) products of an unsaturated fatty acid, such as tall oil acids and oleic acids, with one or more unsaturated carboxylic reagents. These acids are taught in U.S. Pat. No. 2,444,328, the disclosure of which is incorporated herein by reference.

In one embodiment, the unsaturated fatty acid is present insitu as a byproduct of the feedstock used to produce a biologically-derived oxygenate component or a byproduct of extractants used to extract the biologically-derived oxygenate from a fermentation broth.

In another embodiment, the corrosion inhibitor of the present invention comprises tricarboxylic acids. Examples of tricarboxylic acids include trimer acids and the reaction product of an unsaturated carboxylic acid (such as unsaturated fatty acids) and an alpha, beta-unsaturated dicarboxylic acid (such as maleic, itaconic, and citraconic acylating agents, preferably maleic acid). These acids generally contain an average from about 18, or about 30, carbon atoms. The trimer acids are prepared by the trimerization of one or more of the above-described fatty acids. In one embodiment, the tricarboxylic acid or its derivative is the reaction product of one or more unsaturated carboxylic acid, such as an unsaturated fatty acid or alkenyl succinic anhydride and an alpha, beta-unsaturated carboxylic reagent. The unsaturated carboxylic reagents include unsaturated carboxylic acids per se and functional derivatives thereof, such as anhydrides, esters, amides, imides, salts, acyl halides, and nitriles. The unsaturated carboxylic reagent include mono, di, tri or tetracarboxylic reagents. Specific examples of useful monobasic unsaturated carboxylic acids are acrylic acid, methacrylic acid, cinnamic acid, crotonic acid, 2-phenylpropenoic acid, etc. Exemplary polybasic acids include maleic acid, maleic anhydride, fumaric acid, mesaconic acid, itaconic acid and citraconic acid. Generally, the unsaturated carboxylic reagent is maleic anhydride, acid or lower ester, e.g. those containing less than eight carbon atoms. In one embodiment, the unsaturated dicarboxylic acid generally contains an average from about 12 up to about 40, or from about 18 up to about 30 carbon atoms. Examples of these tricarboxylic acids include Empol® 1040 available commercially from Emery Industries, Hystrene® 5460 available commercially from Humko Chemical, and Unidyme® 60 available commercially from Union Camp Corporation.

In another embodiment, the corrosion inhibitor of the present invention comprises hydrocarbyl substituted carboxylic acid. The hydrocarbyl substituted carboxylic acids are prepared by a reaction of one or more olefin or polyalkene with one or more of the above described unsaturated carboxylic reagents. The hydrocarbyl group generally contains from about 30 to about 100 carbon atoms. In one embodiment, the hydrocarbyl group contains from about 8 up to about 40, or from about 10 up to about 30, or from about 12 up to about 24 carbon atoms. In one embodiment, the hydrocarbyl group may be derived from an olefin. The olefins typically contain from about 3 to about 40, or from about 4 to about 24 carbon atoms. These olefins are preferably alpha-olefins (sometimes referred to as mono-1-olefins or terminal olefins) or isomerized alpha-olefins. Examples of the alpha-olefins include 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tetracosene, etc. Commercially available alpha-olefin fractions that can be used include the C15-18 alpha-olefins, C12-C16 alpha-olefins, C14-16 alpha-olefins, C14-18 alpha-olefins, C16-18 alpha-olefins, C16-20 alpha-olefins, C18-24 alpha-olefins, C22-28 alpha-olefins, etc. The hydrocarbyl substituted carboxylic acids are described in U.S. Pat. Nos. 3,219,666 and 4,234,435, the disclosures of which is hereby incorporated by reference.

In another embodiment, the corrosion inhibitor of the present invention may be prepared by reacting one or more of the above described polyalkenes with an excess of maleic anhydride to provide substituted succinic acid wherein the number of succinic groups for each equivalent weight of substituent group, i.e., polyalkenyl group, is at least about preferably at least about 1.4, or more preferably at least about 1.5. The maximum number will generally not exceed about 4.5, or preferably about 3.5. A suitable range is from about 1.4 up to about 3.5, or from about 1.5 up to about 2.5 succinic groups per equivalent weight of substituent groups.

The carboxylic acids are known in the art and have been described in detail, for example, in the following: U.S. Pat. No. 3,215,707 (Rense); U.S. Pat. No. 3,219,666 (Norman et al); U.S. Pat. No. 3,231,587 (Rense); U.S. Pat. No. 3,912,764 (Palmer); U.S. Pat. No. 4,110,349 (Cohen); and U.S. Pat. No. 4,234,435 (Meinhardt et al); and U.K. 1,440,219. The disclosures of these patents are hereby incorporated by reference. These patents are incorporated herein by reference for their disclosure of carboxylic acids and methods for making the same.

In another embodiment, the corrosion inhibitor comprises the reaction product of the above described carboxylic acids with amines to form acylated amines. The amines may be monoamines or polyamines. Useful amines include those amines disclosed in U.S. Pat. No. 4,234,435 at Col. 21, line 4 to Col. 27, line 50, these passages being incorporated herein by reference. The amines may be any of the above described amines, preferably the amine is a polyamine, such as an alkylenepolyamine or a condensed amine.

In one embodiment, the carboxylic acid is present insitu as a byproduct of the feedstock used to produce a biologically-derived oxygenate component or a byproduct of extractants used to extract the biologically-derived oxygenate from a fermentation broth.

In another embodiment, the polyamine is a fatty diamine. The fatty diamines include mono- or dialkyl, symmetrical or asymmetrical ethylenediamines, propanediamines (1,2, or 1,3), and polyamine analogs of the above. Suitable commercial fatty polyamines are Duomeen C(N-coco-1,3-diaminopropane), Duomeen S(N-soya-1,3-diaminopropane), Duomeen T (N-tallow-1,3-diaminopropane), and Duomeen 0 (N-oleyl-1,3-diaminopropane). "Duomeens" are commercially available from AkzoNobel.

In another embodiment, the polyamines are polyoxyalkylene polyamines, e.g. polyoxyalkylene diamines and polyoxyalkylene Hamines. The preferred polyoxyalkylene polyamines include the polyoxyethylene and polyoxypropylene diamines and the polyoxypropylene triamines. The polyoxyalkylene polyamines are commercially available and may be obtained, for example, from the Huntsman Corporation under the trade name "Jeffamines D-230, D-400, D-1000, D-2000, T-403, etc.". U.S. Pat. Nos. 3,804,763 and 3,948,800 are expressly incorporated herein by reference for their disclosure of such polyoxyalkylene polyamines and acylated products made therefrom.

In another embodiment, the polyamines are hydroxy-containing polyamines. Hydroxy-containing polyamine analogs of hydroxy monoamines, particularly alkoxylated alkylenepolyamines, e.g., N,N'-(dihydroxyethyl)ethylene diamines can also be used. Such polyamines can be made by reacting the above-described alkylene amines with one or more of the above-described alkylene oxides. Similar alkylene oxide-alkanol amine reaction products may also be used such as the products made by reacting the above described primary, secondary or tertiary alkanol amines with ethylene, propylene or higher epoxide in a 1.1 to 1.2 molar ratio. Reactant ratios and temperatures for carrying out such reactions are known to those skilled in the art. Specific examples of hydroxy-containing polyamines include N-(2-hydroxyethyl)ethylenediamine, N,N'-bis(2-hydroxyethyl) ethylenediamine, 1-(2-hydroxyethyl)piperazine, mono(hydroxypropyl)-substituted tetraethylene-pentamine, N-(3-hydroxybutyl)tetramethylenediamine, etc. Higher homologs obtained by condensation of the above illustrated hydroxy-containing polyamines through amino groups or through hydroxy groups are likewise useful. Condensation through amino groups results in a higher amine accompanied by removal of ammonia, while condensation through the hydroxy groups results in products containing ether linkages accompanied by removal of water. Mixtures of two or more of any of the above described polyamines are also useful.

In another embodiment, the amine used in preparing the acylated amine corrosion inhibitor may be an alkylenepolyamine. Such alkylenepolyamines include methylenepolyamines, ethylenepolyamines, butylenepolyamines, propylenepolyamines, pentylenepolyamines, etc. The higher homologs and related heterocyclic amines, such as piperazines and N-amino alkyl-substituted piperazines, are also included. Specific examples of such polyamines are ethylenediamine, triethylenetetramine, tris-(2-aminoethyl)amine, propylenediamine, trimethylenediamine, tripropylenetetramine, triethylenetetraamine, tetraethylenepentamine, hexaethyleneheptamine, pentaethylenehexamine, etc. Higher homologs obtained by condensing two or more of the above-noted alkyleneamines are similarly useful as are mixtures of two or more of the above described polyamines.

In one embodiment, the polyamine is an ethylenepolyamine. Such polyamines are described in detail under the heading Ethylene Amines in Kirk Othmer's "Encyclopedia of Chemical Technology", 2d Edition, Vol. 7, pages 22-37, Interscience Publishers, New York (1965). Ethylenepolyamines are often a complex mixture of polyalkylenepolyamines including cyclic condensation products.

Another useful polyamine is a condensation reaction between at least one hydroxy compound with at least one polyamine reactant containing at least one primary or secondary amino group. The hydroxy compounds are preferably polyhydric alcohols and amines. In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20 carbon atoms, or from two to about four. Examples of polyhydric amines include diethanolamine, triethanolamine, tri-(hydroxypropyl)amine, tris-(hydroxymethyl)amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine.

Polyamines which may react with the polyhydric alcohol or amine to form the condensation products or condensed amines, are described above. The condensation reaction of the polyamine reactant with the hydroxy compound is conducted at an elevated temperature in the presence of an acid catalyst.

The amine condensates and methods of making the same are described in PCT publication WO86/05501 and U.S. Pat. No. 5,230,714 (Steckel) which are incorporated by reference for its disclosure to the condensates and methods of making.

Acylated amines and methods thr preparing the same are described in U.S. Pat. Nos. 3,219,666; 4,234,435; 4,952,328; 4,938,881; 4,957,649; and 4,904,401. The disclosures of acylated nitrogen dispersants and other dispersants contained in those patents are hereby incorporated by reference.

In another embodiment, the corrosion inhibitor is a mixture comprising of at least one dimer acid and at least one trimer acid.

In another embodiment, the corrosion inhibitor is a mixture comprising of at least one dimer acid, at least one trimer acid and at least one alkyl dicarboxylic acid, preferably hexadecenyl succinic acid.

In another embodiment, the corrosion inhibitor is an amide formed by the reaction of unsaturated fatty acid and N-methyl glycine such as N-methyl-N-(1-oxo-9-octadecenyl)glycine.

In another embodiment, the corrosion inhibitor is the reaction product of linoleic acid or tall oil fatty acid with acrylic acid, such as 5-carboxy-4-hexyl-2-cyclohexene-1-octanoic acid, 6-carboxy-4-hexyl-2-cyclohexene-1-octanoic acid.

In another embodiment, the corrosion inhibitor is a reaction product of unsaturated fatty acid and N-(2-hydroxyethyl)-1,2-diaminoethane such as 1-(2-hydroxyethyl)-2-(8-heptadecenyl)-2-imidazoline.

In a preferred embodiment, the corrosion inhibitor of the present invention comprises the reaction product of at least one dimer acid, at least one trimer acid, and at least one alkyl dicarboxylic acid, preferably hexadecenyl succinic acid, with an amine or diamine preferably $NH_2(CH_2)n\text{-}NH\text{—}C_{8\text{-}10}$, where n is 1 to about 10. In a most preferred embodiment, the amine is N,N dimethylycyclohexylamine.

In another embodiment, the corrosion inhibitor comprises, by weight, (a) about 35% to 70% of at least one mono- or di-alkenyl succinic acid in which the alkenyl group has 8 to 18 carbons; and (b) about 30% to 65% of an aliphatic or cycloaliphatic amine, diamine or polyamine containing 2 to 12 carbon atoms.

In another embodiment the corrosion inhibitor comprises a composition having by weight (a) about 75% to 95% of at least one polymerized unsaturated aliphatic monocarboxylic acid, said unsaturated acid having 16 to 18 carbons per molecule, and (b) about 5% to 25% of at least one monoalkenylsuccinic acid in which the alkenyl group has 8 to 18 carbons.

In another embodiment the corrosion inhibitor comprises dodecenyl succinic acid (DDSA).

In yet another embodiment, corrosion inhibitors of the present invention comprise at least one of the commercially available products listed in Tables 1 and 2. In Table 1, PTBE refers to the pounds per thousand barrels of the corrosion inhibitor in denatured ethanol. By "PTB" herein is meant "pounds per thousand barrels" a common term of art in the fuel additive industry. A PTB is roughly equivalent to about 4 ppm. In yet another embodiment, the minimum amount or concentration of corrosion inhibitor or mixtures thereof, is about 3 PTB and in another the amount is from about 3 PTB to about 50 PTB, most preferably no more than 30 ptb in the finished oxygenated gasoline.

TABLE 1

| CORROSION INHIBITOR | VENDOR | TREAT RATE |
|---|---|---|
| DCI-11 | Innospec | 10 PTBE |
| Tolad 3222 | Petrolite | 20 PTBE |
| Tolad 3224 | Petrolite | 13 PTBE |
| Nalco 5403 | Nalco | 30 PTBE |
| Nalco EC5624A, EC5624ATR | Nalco | 15 PTBE |
| EndCor GCC 9711 | Dampney Company | 20 PTBE |
| Spec-Aid 8Q5125 | GE BETZ, Inc | 20 PTBE |
| OCI 1016 | JACAM | 10 PTBE |
| MCC5011E | MidContinental | 20 PTBE |
| MCC5011EW | MidContinental | 27 PTBE |
| MCC5011pHe | MidContinental | 10 PTBE |
| Tec 9880 | Afton Chemical | 10 PTBE |
| Tec 9881 | Afton Chemical | 6 PTBE |
| ECI-6 | Ashland Amergy | 6 PTBE |
| SBZ 2005 | SBZ Corporation | 10 PTBE |
| Lubrizol LZ 541 | Lubrizol | 16 PTBE |
| CorrPro 654 | US Water | 13 PTBE |
| CorrPro 656, CorrPro 656T | US Water | 13 PTBE |

TABLE 2

| Corrosion Inhibitor | Vendor | Type | Composition | Process |
|---|---|---|---|---|
| DCI-4A | Innospec | Dicarboxylic Acid | Mixed dimer acid, trimer acid | Tall oil fatty acid Diels-Alder self condensation(s) |
| DCI-6A | Innospec | Dicarboxylic Acid | Mixed dimer acid, (trimer acid) and alkyl carboxylic acid | |
| DCI-11 | Innospec | Buffered | A 1:1 equivalent ratio of acid:amine. Contains the reaction product of an organic acid and an amine or a diamine, such as NH2(CH2)n—NH—C8-10 where n is 1 to about 10. | Low molecular weight (<500) amine salt of a carboxylic acid |

TABLE 2-continued

| Corrosion Inhibitor | Vendor | Type | Composition | Process |
|---|---|---|---|---|
| FOA-3 | Innospec | Amine | N,N-dimethyl cyclohexylamine | |
| DCI-30.n | Innospec | Dicarboxylic Acid | Alkenyl succinic acid, in solvent | |
| DDSA | | Dicarboxylic Acid | Dodecenyl Succinic Acid | "ene" reaction of maleic anhydride and 1-dodecene |
| DDSA (75) | | Dicarboxylic Acid | 75% Dodecenyl Succinic Acid in Solvent | |
| Sarkosyl O | BASF | Carboxylic Acid | N-methyl-N-(I-oxo-9-octadecenyl)glycine | Amide from oleic acid and N-methyl glycine |
| Amine O | BASF | Amine | 1-(2-hydroxyethyl)-2-(8-heptadecenyl)-2-imidazoline; cas 95-38-5 | Oleic acid + N-(2-hydroxyethyl)-1,2-diaminoethane |
| Tolad 245 | Baker Petrolite | Carboxylic Acid | Mixed dimer acid, trimer acid | Tall oil fatty acid Diels-Alder self condensation(s) |
| Tolad 249 | Baker Petrolite | Carboxylic Acid | mixed dimer acid, trimer acid and "synthetic" component | Tall oil fatty acid Diels-Alder self condensation(s) |
| Tolad 357 | Baker Petrolite | | a composition having a molecular weight of about 700 or less comprising (I) an alkenyl succinic acid or anhydride (ASAA), and (2)the reaction product of ASAA and a trialkanol amine such as triethanolamine (TEA) where ASAA (3 moles) is reacted with TEA (1 mole) to yield an amide and/or an amine salt. | |
| Tolad 3222 | Baker Petrolite | Buffered | $NH_2(CH2)_n$—NH—$(CH_2)_m$O—$C_{8-10}$ where n and m are independently 1 to about 10 | |
| Tolad 3224 | Baker Petrolite | Buffered | $NH_2(CH2)_n$—NH—$(CH_2)_m$O—$C_{8-10}$ where n and m are independently 1 to about 10 | |
| Nalco 5403 | Nalco | Dicarboxylic Acid | mixed dimer acid, trimer acid | Tall oil fatty acid Diels-Alder self condensation(s) |
| Nalco 5624A | Nalco | Buffered | A 1:1 equivalent ratio of acid:amine. Contains the reaction product of an organic acid and an amine or a diamine, such as NH2(CH2)n—NH—C8-10 where n is 1 to about 10. | Low molecular weight (<500) amine salt of a carboxylic acid |
| Nalco 5626A | Nalco | Dicarboxylic Acid | "synthetic", Alkenyl succinic acid | |
| Nalco 5405 | Nalco | Dicarboxylic Acid | mixed dimer acid and alkenyl succinic acid (C16 - dodecenyl succinic acid | |
| Armeen HTD | AkzoNobel | Amine | Hydrogenated tallow alkylamine, C16-18 | 70% Octadecylamine; 25% hexadecylamine; 5% octadecenylamine |
| Armeen HT | AkzoNobel | Amine | Hydrogenated tallow alkylamine, C16-19 | |
| Armeen OL | AkzoNobel | Amine | Oleyl amine, C18 | |
| Diacid 1550 | Mead Westvaco | Dicarboxylic Acid | 5(or6)-carboxy-4-hexyl-2-cylcohexene-1-octanoic acid, C22 | Isomerized linoleic acid (or tall oil) Diels-Alder with acrylic acid |
| Specaid 8Q123ULS | GE Betz | Dicarboxylic Acid | dodecenyl butandioic acid (MSDS), 35% in solvent, aka dodecenyl succinic acid | |

The current invention is intended to provide good corrosion protection (i.e. NACE rating of B+ or better) after heat aging for at least 14 days, preferably for at least 30 days, and most preferably for at least 12 weeks.

The current invention is also intended to provide an oxygenated gasoline composition comprising at least two corrosion inhibitors, wherein the total corrosion inhibitor concentration is about 1 to about 50 ptb, or about 2 to about 50 ptb, or about 3.00 ptb to about 50 ptb and the composition has acid/amine equivalence ratio ranging from about 0.1 to about 3, or about 1.00 to about 3.00. In some embodiments, the at least two corrosion inhibitors have an acid/amine equivalence ratio ranging from about 0.1 to about 3, or about 0.1 to about 2, or about 0.1 to about 1.

The current invention is also intended to provide an oxygenated gasoline composition comprising at least three corrosion inhibitors, wherein the total corrosion inhibitor concentration is about 1 to about 50 ptb, or about 2 to about 50 ptb, or about 3.00 ptb to about 50 ptb and the composition has acid/amine equivalence ratio ranging from about 0.1 to about 3, or about 1.00 to about 3.00. In some embodiments, the at least three corrosion inhibitors have an acid/amine equivalence ratio ranging from about 0.1 to about 3, or about 0.1 to about 2, or about 0.1 to about 1.

The current invention is also intended to provide an oxygenated gasoline composition comprising at least four corrosion inhibitors, wherein the total corrosion inhibitor concentration is about 1 to about 50 ptb, or about 2 to about 50 ptb, or about 3.00 ptb to about 50 ptb and the composition has acid/amine equivalence ratio ranging from about 0.1 to about 3, or about 1.00 to about 3.00. In some embodiments, the at least four corrosion inhibitors have an acid/amine equivalence ratio ranging from about 0.1 to about 3, or about 0.1 to about 2, or about 0.1 to about 1.

In some embodiments, the invention provides an oxygenated gasoline composition comprising one or more corrosion inhibitors, wherein the concentration of the corrosion inhibitor is about 0.5 ptb to about 7 ptb, about 0.5 ptb to about 6 ptb, or about 0.5 ptb to about 5 ptb and wherein one or more corrosion inhibitors have an acid:amine equivalence ratio of about 1:10 to about 1:0.

In some embodiments, the invention provides an oxygenated gasoline composition comprising about 1 to about 30 v/v % of a renewable biologically-derived alcohol and one or more corrosion inhibitors whereby a substantially renewable and anti-corrosive composition is formed. In some embodiments, the alcohol is selected from the group consisting of methanol, ethanol, propanol, butanol, isobutanol, pentanol, hexanol, heptanol, octanol, and mixtures thereof. In some embodiments, the concentration of the corrosion inhibitor is about 0.5 ptb to about 7 ptb, about 0.5 ptb to about 6 ptb, or about 0.5 ptb to about 5 ptb. In some embodiments, the one or more corrosion inhibitors have an acid:amine equivalence ratio of about 1:10 to about 1:0. In some embodiments, the one or more corrosion inhibitors have an acid:amine equivalence ratio of about 0.1 to about 3.

in some embodiments of the invention, the corrosion inhibitors have an acid:amine equivalence ratio of about 1:12 to about 1:0, about 1:11 to about 1:0, about 1:10 to about 1:0, or about 1:9 to about 1:0. In some embodiments, one or more corrosion inhibitors have an acid:amine equivalence ratio of about 1:9. In other embodiments, one or more corrosion inhibitors have an acid:amine equivalence ratio of about 1:0. In other embodiments, the corrosion inhibitors have an acid:amine equivalence ratio of at least about 1:12, at least about 1:11, at least about 1:10, at least about 1:9, at least about 1:8, at least about 1:7, at least about 1:6, at least about 1:5, at least about 1:4, at least about 1:3, at least about 1:2, at least about 1:1, or about 1:0 (i.e., no detectable amine).

In some embodiments of the invention, one or more corrosion inhibitors have an amine nitrogen content of less than about 500 ppm, less than about 100 ppm, less than about 90 ppm, less than 80 ppm, less than about 70 ppm, less than about 60 ppm, or less than about 50 ppm. In some embodiments, one or more corrosion inhibitors have no detectable amine.

In some embodiments of the invention, one or more corrosion inhibitors comprise about 1 to about 15 wt/wt %, about 3 to about 13 wt/wt %, about 5 to about 10 wt/wt %, or about 6 to about 9 wt/wt % of an alkyl or alkenyl carboxylic acid.

In some embodiments, the one or more corrosion inhibitors comprising an alkyl or alkenyl carboxylic acid further comprise at least 50 wt/wt %, at least 60 wt/wt %, at least 70 wt/wt %, at least 80 wt/wt %, at least 90 wt/wt %, or about 50 to about 100 wt/wt %, about 60 to 100 wt/wt %, or about 70 to 100 wt/wt % of at least one amine.

BioTEC® 9881 (listed as Tec 9881 in Table 1) is an example of a commercially available corrosion inhibitor in accordance with the invention which is believed to contain about 60 to about 100 wt/wt % of alkyl amine, and about 5 to about 10 wt/wt % of a long chain carboxylic acid.

In some embodiments of the invention, the concentration of one or more corrosion inhibitors in the oxygenated gasoline composition is about 0.5 ptb to about 7 ptb, about 0.5 ptb to about 6 ptb, about 0.5 ptb to about 5 ptb, about 1 ptb to about 4 ptb, about 1 ptb to about 3 ptb, about 1 ptb to about 2 ptb, about 1.2 ptb, about 1.4 ptb, about 1.6 ptb, or about 1.8 ptb.

In some embodiments of the invention, the concentration of one or more corrosion inhibitors in the oxygenated gasoline composition is about 0.5 ptb to about 7 ptb, about 0.5 ptb to about 6 ptb, about 0.5 ptb to about 5 ptb, about 3 ptb to about 5 ptb, about 3 ptb to about 4 ptb, about 3 ptb, about 4 ptb, or about 5 ptb.

The corrosion inhibitors of the present invention are usable with oxygenated gasoline blend stocks which can be produced from a single component, such as the product from a refinery alkylation unit or other refinery streams. However, gasoline blend stocks are more commonly blended using more than one component. Gasoline blend stocks are blended to meet desired physical and performance characteristics and to meet regulatory requirements and may involve a few components, for example three or four, or may involve many components, for example, twelve or more.

Gasolines and gasoline blend stocks optionally may include other chemicals or additives. For example, additives or other chemicals can be added to adjust properties of a gasoline to meet regulatory requirements, add or enhance desirable properties, reduce undesirable detrimental effects, adjust performance characteristics, or otherwise modify the characteristics of the gasoline. Examples of such chemicals or additives include detergents, deposit control additives, antioxidants, stability enhancers, demulsifiers, corrosion inhibitors, metal deactivators, and others. More than one additive or chemical can be used.

Useful additives and chemicals are described in Colucci et al., U.S. Pat. No. 5,782,937, which is incorporated by reference herein. Such additives and chemicals are also described in Wolf, U.S. Pat. No. 6,083,228, and Ishida et al., U.S. Pat. No. 5,755,833, Schwahn U.S. Pat. No. 7,601,185, Wolf, WO 2010/091069, all of which are incorporated by reference herein. Gasolines and gasoline blend stocks may also contain solvents or carrier solutions which are often used to deliver additives into a fuel. Examples of such solvents or carrier solutions include, but are not limited to, mineral oil, alcohols, carboxylic acids, synthetic oils, and numerous other which are known in the art.

In another embodiment, the corrosion inhibitors of the present invention may be formulated as part of a deposit control additive (DCA) package. Such DCA may include the reaction products of certain aldehydes or ketones with the following conventional unmodified nitrogen-containing detergent additives disclosed in U.S. Pat. No. 6,652,667: aliphatic hydrocarbyl substituted amines, hydrocarbyl-substituted poly(oxyalkylene)amines, hydrocarbyl-substituted succinimides, Mannich reaction products, polyalkylphenoxyaminoalkanes, nitro and amino aromatic esters of polyalkylphenoxyalkanols, carburetor/injector detergent additives having a molecular weight in the range of from 100 to 600 and having a non-polar moiety and nitrogen-containing polar moiety, or mixtures thereof.

The aliphatic hydrocarbyl-substituted amines which may be employed as reactants in the manufacture of the deposit control additives are typically straight or branched chain hydrocarbyl-substituted amines having at least one basic nitrogen atom and wherein the hydrocarbyl group has a number average molecular weight of about 400 to 3,000. Preferred aliphatic hydrocarbyl-substituted amines include polyisobutenyl and polyisobutyl monoamines and polyamines. Such aliphatic hydrocarbyl amines can be prepared by conventional procedures known in the art. Suitable preparations are described in detail in U.S. Pat. Nos. 3,438,757; 3,565,804; 3,574,576; 3,848,056; 3,960,515; 4,832,702; and 6,203,584, the disclosures of which are incorporated herein by reference.

Another class of reactants in the manufacture of the DCA are the hydrocarbyl-substituted poly(oxyalkylene)amines, also referred to as polyether amines. Typical hydrocarbyl-substituted poly(oxyalkylene)amines include hydrocarbyl poly(oxyalkylene)monoamines and polyamines wherein the hydrocarbyl group contains from 1 to about 30 carbon atoms, the number of oxyalkylene units will range from about 5 to 100, and the amine moiety is derived from ammonia, a primary alkyl or secondary dialkyl monoamine, or a polyamine having a terminal amino nitrogen atom. Preferably, the oxyalkylene moiety will be oxypropylene or oxybutylene or a mixture thereof. Such hydrocarbyl-substituted poly(oxyalkylene)amines are described, for example, in U.S. Pat. Nos. 6,217,624 and 5,112,364, the disclosures of which are incorporated herein by reference.

A preferred type of hydrocarbyl-substituted poly(oxyalkylene)monoamine is an alkylphenyl poly(oxyalkylene) monoamine wherein the poly(oxyalkylene) moiety contains oxypropylene units or oxybutylene units or mixtures of oxypropylene and oxybutylene units. Preferably, the alkyl group on the alkylphenyl moiety is a straight or branched-chain alkyl of 1 to 24 carbon atoms. An especially preferred alkylphenyl moiety is tetrapropenylphenyl, that is, where the alkyl group is a branched-chain alkyl group of 12 carbon atoms derived from propylene tetramer.

An additional type of hydrocarbyl-substituted poly(oxyalkylene)amine for use as reactants in the manufacture of the deposit control additives of the present invention is hydrocarbyl-substituted poly(oxyalkylene)aminocarbamates disclosed, for example, in U.S. Pat. Nos. 4,288,612; 4,236,020; 4,160,648; 4,191,537; 4,270,930; 4,233,168; 4,197,409; 4,243,798 and 4,881,945, the disclosures of which are incorporated herein by reference. These hydrocarbyl poly (oxyalkylene)aminocarbamates contain at least one basic nitrogen atom and have an average molecular weight of about 500 to 10,000, preferably about 500 to 5,000, and more preferably about 1,000 to 3,000. A preferred aminocarbamate is alkylphenyl poly(oxybutylene)aminocarbamate wherein the amine moiety is derived from ethylene diamine or diethylene triamine.

A further class of reactants in the manufacture of the deposit control additives of the present invention is the hydrocarbyl-substituted succinimides. Typical hydrocarbyl-substituted succinimides include polyalkyl and polyalkenyl succinimides wherein the polyalkyl or polyalkenyl group has an average molecular weight of about 500 to 5,000, and preferably about 700 to 3,000. The hydrocarbyl-substituted succinimides are typically prepared by reacting a hydrocarbyl-substituted succinic anhydride with an amine or polyamine having at least one reactive hydrogen bonded to an amine nitrogen atom. Preferred hydrocarbyl-substituted succinimides include polyisobutenyl and polyisobutanyl succinimides, and derivatives thereof. The hydrocarbyl-substituted succinimides are described, for example, in U.S. Pat. Nos. 5,393,309; 5,588,973; 5,620,486; 5,916,825; 5,954,843; 5,993,497; and 6,114,542, and British Patent No. 1,486,144, the disclosures of which are incorporated herein by reference.

Yet another class of reactants in the manufacture of the deposit control additives of the present invention is Mannich reaction products which are typically obtained from the Mannich condensation of a high molecular weight alkyl-substituted hydroxyaromatic compound, an amine containing at least one reactive hydrogen, and an aldehyde. The high molecular weight alkyl-substituted hydroxyaromatic compounds are preferably polyalkylphenols, such as polypropylphenol and polybutylphenol, especially polyisobutylphenol, wherein the polyakyl group has an average molecular weight of about 600 to 3,000. The amine reactant is typically a polyamine, such as alkylene polyamines, especially ethylene or polyethylene polyamines, for example, ethylene diamine, diethylene triamine, triethylene tetramine, and the like. The aldehyde reactant is generally an aliphatic aldehyde, such as formaldehyde, paraformaldehyde, formalin, and acetaldehyde. A preferred Mannich reaction product is obtained by condensing a polyisobutylphenol with formaldehyde and diethylene triamine, wherein the polyisobutyl group has an average molecular weight of about 1,000. The Mannich reaction products are described, for example, in U.S. Pat. Nos. 4,231,759 and 5,697,988, the disclosures of which are incorporated herein by reference.

Other reactants in the manufacture of the deposit control additives of the present invention are polyalkylphenoxyaminoalkanes, nitro and amino aromatic esters of polyalkylphenoxyalkanols, and mixtures of nitro and amino aromatic esters of polyalkylphenoxyalkanols and hydrocarbyl-substituted poly(oxyalkylene)amines. These mixtures are described in detail in U.S. Pat. No. 5,749,929, the disclosure of which is incorporated herein by reference.

Preferably, the compositions of the detergent or deposit control additives used in conjunction with the corrosion inhibitors of the present invention are the imine or tertiary amine products of the reaction between the aforesaid reactants and selected aldehydes or ketones of low (less than 100) carbon number. Each of the above described unmodified deposit control additives contains a primary and/or secondary amine functionality, which functionality can be modified by reaction with suitable low carbon number aldehydes or ketones having the formulas: R16CHO, R16CH2 CHO, R17(C═O)R18 and R17CH2(C═O)R18, where R16, R17, and R18 can be the same or different and are each independently a straight or branched chain hydrocarbyl or aryl group that contains from 1 to 18 carbon atoms, preferably from 1 to 8 carbon atoms. Typically a solvent such as isobutanol is employed in the reaction.

In a most preferred embodiment, the deposit control additive works synergistically with the corrosion inhibitors of the present invention to improve corrosion protection and storage stability. Treat rates of DCAs are preferably 27 to 45 ptb for one times Lowest Additive Concentration. Two to four times this amount can be used up to a preferred maximum treat rate of about 100 ptb.

In one aspect of the invention, the corrosion protection and storage stability of the oxygenated gasoline composition is maintained for at least 2 weeks, preferably for 12 weeks, most preferably for 120 days.

Other conventional components and assistants that may be employed are antioxidants such as butylated hydroxytoluene, 2,4-Dimethyl-6-tert-butylphenol, 2,6-Di-tert-butylphenol (2,6-DTBP), p-Phenylenediamine, diaryl amines, bis(octylphenyl)amine, N,N'-di-sec-butyl-p-phenylenediamine, ethylene diamine; or stabilizers, for example based on amines, such as p-phenylenediamine, N,N-dimethylcyclohexylamine, dicyclohexylamine or derivatives thereof and on phenols, such as 2,4-di-tert-butylphenol or 3,5-di-tert-butyl-4-hydroxyphenylpropionic acid; dehazers, demulsifiers, antistatic agents, metallocenes such as ferrocene or methylcyclopentadienyl manganese tricarbonyl, lubricity additives such as certain fatty acids, alkenylsuccinic esters, bis(hydroxyalkyl)fatty amines, hydroxyacetamides and castor oil; antiknock additives such as tetra-ethyl lead, methylcyclopentadienyl manganese tricarbonyl (MMT), ferrocene, Iron pentacarbonyl, toluene, isooctane, triptane, anti-icing additives, ethers such as methyl tert-butyl ether, tertiary amyl methyl ether, tertiary hexyl methyl ether, ethyl tertiary butyl ether, tertiary amyl ethyl ether, diisopropyl ether, octane requirement additives, lead scavengers (for leaded gasoline) including tricresyl phosphate (TCP), 1,2-Dibromoethane, 1,2-Dichloroethane; and also colorants including Solvent Red 24, Solvent Red 26, Solvent Yellow 124, Solvent Blue 35.

Gasoline blend stocks suitable for use in the method of this invention are typically blend stocks useable for making gasolines for consumption in spark ignition engines or in other engines which combust gasoline. Suitable gasoline blend stocks include blend stocks for gasolines meeting ASTM D4814 and blend stocks for reformulated gasoline. Suitable gasoline blend stocks also include blend stocks having low sulfur content which may be desired to meet regional requirements, for example having less than about 150, preferably less than about 100, and more preferably less than about 80, or less than about 30, or less than about 10 parts per million parts by volume of sulfur. Such suitable gasoline blend stocks also include blend stocks having low aromatics content which may be desirable to meet regulatory requirements, for example having less than about 8000 and preferably less than about 7000, or less than about 6200, or less than about 4000 parts per million parts by volume of benzene.

An oxygenate such as methanol, ethanol, butanol, or mixtures thereof is blended with the gasoline blending stock. In that case, the resulting gasoline blend includes a blend of one or more gasoline blending stocks and one or more suitable oxygenates. In another embodiment, one or more butanol isomers can be blended with one or more gasoline blending stocks and, optionally, with one or more suitable oxygenates such as ethanol. In such embodiment, one or more gasoline blend stocks, one or more butanol isomers and optionally one or more suitable oxygenates can be blended in any order. For example, a butanol can be added to a mixture, including a gasoline blend stock and suitable oxygenates. As another example, one or more suitable oxygenates and a butanol can be added in several different locations or in multiple stages. For further examples, a butanol, more preferably isobutanol, can be added with the suitable oxygenates, added before the suitable oxygenates or blended with the suitable oxygenates before being added to a gasoline blend stock. In a preferred embodiment, a butanol, more preferably isobutanol, is added to oxygenated gasoline. In another preferred embodiment, one or more suitable oxygenates and a butanol can be blended into a gasoline blend stock contemporaneously.

In any such embodiment the one or more butanol and optionally one or more suitable oxygenates can be added at any point within the distribution chain. For example, a gasoline blend stock can be transported to a terminal and then a butanol and optionally one or more suitable oxygenates can be blended with the gasoline blend stock, individually or in combination, at the terminal. As a further example, the one or more gasoline blending stocks, one or more butanol isomers and optionally one or more suitable oxygenates can be combined at a refinery. Other components or additives can also be added at any point in the distribution chain. Furthermore, the method of the present invention can be practiced at a refinery, terminal, retail site, or any other suitable point in the distribution chain.

Oxygenates of the present invention can arise in or be provided in many qualities or grades, such as commercial or fuel grade, as well as pure or reagent grade, and can be derived from any source such as but not limited to petroleum refinery streams, distillation cuts, and biologically-derived (e.g. bioethanol, biobutanol from corn or other crops or renewable substrates).

In one embodiment, oxygenates of the oxygenated gasoline composition of the present invention comprise at least 5% renewable component. In a preferred embodiment, said renewable component comprises biologically-derived ethanol, biologically-derived butanol or mixtures thereof.

In some embodiments, the oxygenate is corrosion inhibited. The corrosion inhibited oxygenate can have about 90 to about 100 wt/wt % of an alcohol and about 10 to 200 ptb of a corrosion inhibitor. In some embodiments, the corrosion inhibitor can be any of the corrosion inhibitors discussed herein. In some embodiments of the invention, the corrosion inhibitors have an acid:amine equivalence ratio of about 1:12 to about 1:0, about 1:11 to about 1:0, about 1:10 to about 1:0, or about 1:9 to about 1:0. In some embodiments, one or more corrosion inhibitors have an acid:amine equivalence ratio of about 1:9. In other embodiments, one or more corrosion inhibitors have an acid:amine equivalence ratio of about 1:0. In other embodiments, the corrosion inhibitors have an acid:amine equivalence ratio of at least about 1:12, at least about 1:11, at least about 1:10, at least about 1:9, at least about 1:8, at least about 1:7, at least about 1:6, at least about 1:5, at least about 1:4, at least about 1:3, at least about 1:2, at least about 1:1, or about 1:0 (i.e., no detectable amine). In some embodiments, the alcohol is biologically derived. In some embodiments, the alcohol is selected from the group consisting of methanol, ethanol, propanol, butanol, isobutanol, pentanol, hexanol, heptanol, octanol, and mixtures thereof.

In some embodiments, such a corrosion inhibited oxygenate is used in a method of manufacturing oxygenated gasoline. In some embodiments the method includes blending the corrosion inhibited oxygenate with gasoline base stock to make oxygenated gasoline. In some embodiments, the corrosion inhibited oxygenate comprises an alcohol that is biologically derived. In some embodiments, the alcohol is selected from the group consisting of methanol, ethanol, propanol, butanol, isobutanol, pentanol, hexanol, heptanol, octanol, and mixtures thereof.

For preference, the oxygenated gasoline according to the invention can be manufactured from already existing fuel blends. One of these blends could be an E85 fuel, with a proportion of 70 to 85% by volume of ethanol and 15 to 30% by volume of base fuel. The other blend could comprise 30 to 60% by volume of base fuel and 40 to 70% by volume of at least one butanol isomer, preferably isobutanol. Both of these blends can be mixed together to produce oxygenated gasoline fuel comprising about 15-70% by volume of base fuel, about 5-65% by volume of ethanol and about 5 to 50% butanol, particularly isobutanol.

In one embodiment, the oxygenated gasoline comprises no more than 5 v/v % methanol.

In another embodiment, the oxygenated gasoline comprises no more than 10 v/v % ethanol.

In another embodiment, the oxygenated gasoline comprises no more than 20 v/v % ethanol.

In another embodiment, the oxygenate comprises no more than 30 v/v % ethanol.

In another embodiment, the oxygenated gasoline comprises no more than 10 v/v % butanol.

In another embodiment, the oxygenated gasoline comprises no more than 20 v/v % butanol.

In another embodiment, the oxygenated gasoline comprises no more than 30 v/v % butanol.

In another embodiment, the oxygenated gasoline comprises no more than 40 v/v % butanol.

In another embodiment, the oxygenated gasoline comprises about 16 v/v % butanol.

In another embodiment, the oxygenated gasoline comprises about 24 v/v % butanol.

In a preferred embodiment, the oxygenated gasoline blend comprises at least about 10 volume percent, more preferably at least about 16 volume percent, and most preferably at least about 24 volume percent of the at least one butanol isomer.

Although the corrosion inhibitors used herein will generally be added to an oxygenated gasoline, they may also be formulated as a concentrate using at least one organic solvent. Corrosion inhibiting composition of the present invention may be prepared in the form of a solvent solution wherein the solvent comprises from about 15-65% by weight of the composition. Suitable solvents are normally liquid organic compounds boiling in the hydrocarbon fuel boiling range, particularly hydrocarbons and alcohols, and include hexane, cyclohexane, heptane, octane, isooctane, benezene, toluene, xylenes, methanol, ethanol, propanol, butanol, gasolines, jet fuels, fuel oils and the like. Mixtures of solvents can also be used. In some embodiments of the invention, a mixture of xylenes and ethyl benzene is used with a corrosion inhibitor.

Preferably, an aromatic hydrocarbon solvent (such as toluene, xylenes, or higher boiling aromatics or aromatic thinners, and the like) is used. Aliphatic alcohols containing from 3 to 8 carbon atoms (such as isopropanol, isobutylcarbinol, n-butanol, and the like), alone or in combination with hydrocarbon solvents, can also be used.

Suitable alkoxy mono- or poly(oxyalkylene) alcohols solvents for use in formulating the corrosion inhibitors include, for example, 2-methoxyethanol, 2-ethoxyethanol, 2-n-butoxyethanol, 1-methoxy-2-propanol, 1-ethoxy-2-propanol, 1-n-butoxy-2-propanol, diethylene glycol methyl ether, diethylene glycol butyl ether, propylene ethylene glycol methyl ether, propylene ethylene glycol butyl ether, dipropylene glycol methyl ether, dipropylene glycol butyl ether, and the like, including mixtures thereof. A preferred alkoxy mono- or poly(oxyalkylene) alcohol is 2-n-butoxyethanol. A commercial 2-n-butoxyethanol, or ethylene glycol mono-butyl ether, is available as EB Butyl Cellusolve from The Dow Chemical Company.

Suitable aliphatic solvents also include dearomatized solvents such as Exxsol D40 and D60, available from ExxonMobil, other aliphatic solvents, such as D15-20 Naphtha, D115-145 Naphtha and D31-35 Naphtha, also available from ExxonMobil, and nonaromatic mineral spirits, and the like.

It is known that excess acidic components, such as acetic acid and sulfuric acidic species, contribute to wear and deposit accumulation in the engines and/or on the valves or other engine parts. Dispersants may be used to help raise the pH of the oxygenated gasoline slightly by buffering the acetic and/or sulfuric acid components, thereby reducing or preventing the formation of deposit-contributing reaction products. The dispersant, when used will also be useful in buffering the acid corrosion inhibitors.

It is preferred that the equivalence ratio of acid to amine in the corrosion inhibited oxygenated gasoline composition range from about 1 to about 3, preferably about 1 to about 2, most preferably, about 1. In other embodiments, the one or more corrosion inhibitors in the oxygenated gasoline composition have an equivalence ratio of acid to amine in a range from about 0.1 to about 3, about 0.1 to about 2, or about 0.1 to about 1. Primary, secondary, or tertiary aliphatic monoamines may be used to adjust the equivalence ratio of amine to carboxylic acid. Such primary amines include but are not limited to butyl amine, hexyl amine, octyl amine, n-dodecyl amine, n-tetradecyl amine, n-hexadecylamine, lauryl amine, myristyl amine, palmityl amine, stearyl amine, and oleyl amine, Cetylamine, N-Tetradecylamine Cocoamine, Alkyl(C16 and C18-unsaturated) amine, Alkyl(C14-18) amine, Alkyl(C16-22) amine, Alkyl(C8-18 and C18-unsaturated) amine, Alkyl(C12-18) amine. Other commercially available primary amines include coconut oil amine, tallow amine, hydrogenated tallow amine and cottonseed oil amine.

Examples of secondary and tertiary amines that can be used include but are not limited to dibutylamine, Dicyclohexylamine, N,N-dimethylcyclohexylamine, Di(hydrogenated tallow)amine, Dicocoalkyl amine, Dialkyl(C14-18) amine, Dialkyl(C12-18) amine, Dialkyl(C16-22) amine, N-Tridecyltridecanamine, N-Methylstearylamine, Distearyl amine, Dialkyl(C8-20) amine, N-Octadecylbenzylamine, N-Isopropyloctadecylamine, N-Hexadecyloctadecylamine, Dimantine, N-Methyldioctadecylamine, Dimethyl palmitamine, Cocodimethylamine, Alkyl(C10-16)dimethyl amine, Alkyl(C14-18)dimethyl amine, Alkyl(C16-18 and C18-unsaturated)dimethyl amine, Alkyl(C16-18)dimethyl amine, Alkyl(C12-18)dimethyl amine, Alkyl(C16-22)dimethyl amine, Oleyldimethylamine, N-Methyldidecylamine, N,N-Dioctylmethylamine, Dicocomethylamine, Dihydrogenated tallowmethyl amine, Trialkyl(C6-12) amine, N,N-Dioctyloctyl amine, Trialkyl(C8-10) amine, Cocopropylenediamine, Lauryipropylenediamine, N-Dodecylpropylenediamine, Laurylamine dipropylenediamine, N-(Tallow alkyl) dipropylenetriamine, N-(Tallow alkyl)dipropylenetriamine, N-Stearoyltetraethylenetetramine, octyl dimethyl amine, octadecyl dimethyl amine, octadecyl methyl benzyl amine, hexyldiethylamine, trilaurylamine, tricoconut amine, tricaprylyl amine, and similar type compounds also may be used.

The acid/amine equivalence ratio may be determined by any method known in the art.

EXAMPLES

The present invention will be explained in more detail below by reference to the following examples. However, the invention should not be construed as being limited thereto.

Not all commercial corrosion inhibitors provide corrosion protection for gasoline alcohol blends (such as isobutanol and methanol/cosolvent) after aging for significant time periods (e.g., 30 days to 12 weeks) at elevated temperature (e.g., 110° F.). Aging at 110° F. is a test for performance during long term (e.g., 1 year) ambient storage. It has been unexpectedly found that different alcohols respond differently to a corrosion inhibitor, and that simply increasing corrosion inhibitor amounts does not necessarily provide better corrosion protection. It has also been unexpectedly found that certain corrosion inhibitors provide superior corrosion protection and are able to provide corrosion protection at low concentrations, which are more economical and preferred.

A National Association of Corrosion Engineers (NACE) testing of corrosion inhibitors in accordance with the invention is shown below.

NACE TM0172-2001—Determining Corrosive Properties of Cargoes in Petroleum Product Pipelines provides a uniform method of testing the corrosive properties of petroleum product pipeline cargoes and is used herein to test the corrosion properties of the oxygenated gasoline of the present invention. NACE TM0172-2001 is incorporated herein by reference in its entirety. In this test method, the surface of a cylindrical steel test specimen is prepared and then immersed in a mixture of the test fuel and distilled water. The mixture is stirred and is maintained at a prescribed temperature. The test specimen is then rated by the proportion of test surface that has corroded. Experience has shown that if enough inhibitor is present to produce B+ or better results as defined in this standard, general corrosion in flowing pipelines may be controlled.

Examples 1-20

The examples that follow use un-additized, unleaded gasoline that meets the requirements of ASTM D4814 Standard Specification for Automotive Spark-Ignition Engine Fuel with the exception of exhibiting a "C" rating or worse by the NACE Standard Test Method TM0172-2001 as the gasoline blendstock. Fuel oxygenate, that represents typical production from a manufacturing plant process for blending with gasolines for use as automotive spark-ignition engine fuel is used as the fuel oxygenate blendstock. The desired gasoline/oxygenate fuel ratio with the candidate corrosion inhibitor utilizing the recommended treat rate is blended.

The corrosion rating with test method NACE TM0172-2001 is determined. The fuel blend with candidate corrosion inhibitor meeting a NACE Standard Test rating of B+ (less than 5% surface rust) or better for the applied treat rate is deemed acceptable. The treat rate used in this invention may vary from recommended treat rate. Preferably the total corrosion inhibitor concentration is from about 3 to about 50 pounds per thousand barrels of the oxygenated fuel blend. More preferably, it is about 3 to about 20 pounds per thousand barrels of the oxygenated fuel blend, and most preferably not more than 15 ptb.

The corrosion rating using NACE TM0172-2001 of the same desired gasoline/oxygenate fuel ratio blend is determined after 14 days, 30 days, or 12 weeks of storage at 110° F. The fuel blend with candidate corrosion inhibitor again meeting a NACE Standard Test rating of B+ (less than 5% surface rust) or better after at least 14 days of storage, preferably after 30 days, and preferably after at least 12 weeks is deemed acceptable. Samples are stored under laboratory conditions at 110° F., in a non metal container, protected from UV light and following all safety precautions.

Table 3 shows NACE test results for gasoline containing either a methanol cosolvent blend or isobutanol with typical buffered corrosion inhibitors. While DCI-11 and Nalco 5624A provide corrosion protection through 12 weeks heat aging for the methanol-cosolvent blend, they both fail to provide good protection for the isobutanol blend. This is unexpected in that isobutanol should be more like conventional gasoline and common corrosion inhibitors should provide good protection.

Table 4 shows unusual heat age behavior for similar blends using corrosion inhibitor treat levels near the recommended maximum. Unexpectedly, these higher treat levels do not provide protection for either the methanol-cosolvent blend or the isobutanol blend at 12 weeks.

Table 5 shows NACE test results after 14 day heat aging.

Table 6 contains composition data on the Base Gasoline used in the examples.

TABLE 3

| | Composition ID (Example) | | | | | |
|---|---|---|---|---|---|---|
| | 1 | 2 | 3 | 4 | 5 | 6 |
| Base Gasoline 1 | 100 | 92.4 | 92.4 | 92.4 | 84 | 84 |
| Methanol | 0 | 4.98 | 4.98 | 4.98 | 0 | 0 |
| Ethanol | 0 | 0.71 | 0.71 | 0.71 | 0 | 0 |
| n-Propanol | 0 | 0.32 | 0.32 | 0.32 | 0 | 0 |
| Butanol (70/30 Iso-butanol/n-butanol) | 0 | 0.44 | 0.44 | 0.44 | 0 | 0 |
| Pentanol (70/30 iso-pentanol/n-pentanol) | 0 | 0.51 | 0.51 | 0.51 | 0 | 0 |
| Hexanol (70/30 iso-hexanol/n-hexanol) | 0 | 0.36 | 0.36 | 0.36 | 0 | 0 |
| Heptanol | 0 | 0.08 | 0.08 | 0.08 | 0 | 0 |
| Octanol | 0 | 0.02 | 0.02 | 0.02 | 0 | 0 |
| Ketones, (30/70 Methyl isopropyl ketone/methyl isobutyl ketone) | 0 | 0.11 | 0.11 | 0.11 | 0 | 0 |
| N pentyl acetate | 0 | 0.05 | 0.05 | 0.05 | 0 | 0 |
| Water | 0 | 0.01 | 0.01 | 0.01 | 0 | 0 |
| n-heptane | 0 | 0.02 | 0.02 | 0.02 | 0 | 0 |
| Isobutanol | 0 | 0 | 0 | 0 | 16 | 16 |
| DCI-11, ptb | 0 | 0 | 3 | 0 | 3 | 0 |
| Nalco 5642A, ptb | 0 | 0 | 0 | 1.65 | 0 | 1.65 |
| NACE, Fresh | E | D | A | A | B+ | B+ |
| NACE, 30 days, 110° F. | Not Aged | E | A | B+ | C | C |
| NACE, 12 Weeks, 110° F. | Not Aged | E | A | A | C | C |

TABLE 4

| | Composition ID (Example) | | | | | |
|---|---|---|---|---|---|---|
| | 7 | 8 | 9 | 10 | 11 | 12 |
| Base Gasoline 2 | 100 | 92.4 | 92.4 | 92.4 | 84 | 84 |
| Methanol | 0 | 4.98 | 4.98 | 4.98 | 0 | 0 |
| Ethanol | 0 | 0.71 | 0.71 | 0.71 | 0 | 0 |
| n-Propanol | 0 | 0.32 | 0.32 | 0.32 | 0 | 0 |
| Butanol (70/30 Iso-butanol/n-butanol) | 0 | 0.44 | 0.44 | 0.44 | 0 | 0 |
| Pentanol (70/30 iso-pentanol/n-pentanol) | 0 | 0.51 | 0.51 | 0.51 | 0 | 0 |
| Hexanol (70/30 iso-hexanol/n-hexanol) | 0 | 0.36 | 0.36 | 0.36 | 0 | 0 |
| Heptanol | 0 | 0.08 | 0.08 | 0.08 | 0 | 0 |
| Octanol | 0 | 0.02 | 0.02 | 0.02 | 0 | 0 |
| Ketones, (30/70 Methyl isopropyl ketone/methyl isobutyl ketone) | 0 | 0.11 | 0.11 | 0.11 | 0 | 0 |
| N pentyl acetate | 0 | 0.05 | 0.05 | 0.05 | 0 | 0 |
| Water | 0 | 0.01 | 0.01 | 0.01 | 0 | 0 |
| n-heptane | 0 | 0.02 | 0.02 | 0.02 | 0 | 0 |
| Isobutanol | 0 | 0 | 0 | 0 | 16 | 16 |
| DCI-11, ptb | 0 | 0 | 0 | 8 | 0 | 8 |
| Nalco 5642A, ptb | 0 | 0 | 8 | 0 | 8 | 0 |
| NACE, Fresh | D | B | A | B++ | A | B++ |
| NACE, 30 days, 110° F. | Not Aged | C | B+ | E | B+ | B+ |
| NACE, 12 Weeks, 110° F. | Not Aged | E | E | E | E | C |

TABLE 5

| | Composition ID (Example) | | | | | | | |
|---|---|---|---|---|---|---|---|---|
| | 13 | 14 | 15 | 16 | 17 | 18 | 19 | 20 |
| Base Gasoline 3 | 84 | 84 | 84 | 84 | 84 | 84 | 84 | 84 |
| Isobutanol | 16 | 16 | 16 | 16 | 16 | 16 | 16 | 16 |
| DCI-6A, ptb | 1.27 | 0 | 0 | 0 | 1.27 | 1.12 | 0 | 0 |
| Tolad 249, ptb | 0 | 1.24 | 1.35 | 1.04 | 0 | 0 | 0 | 0 |
| DDSA, ptb | 1.01 | 0.76 | 1.01 | 0.51 | 0 | 0.77 | 1.54 | 2.03 |
| FOA-3, ptb | 0.7 | 0.97 | 0.61 | 0 | 0.58 | 1.09 | 1.45 | 0.95 |
| Armeen HTD, ptb | 0 | 0 | 0 | 1.43 | 0 | 0 | 0 | 0 |
| Diacid 1550, ptb | 0 | 0 | 0 | 0 | 1.16 | 0 | 0 | 0 |
| Total CI, ptb | 2.98 | 2.98 | 2.96 | 2.99 | 3 | 2.98 | 2.99 | 2.98 |
| Acid/Amine, eq/eq | 1.96 | 0.99 | 1.99 | 0.98 | 1.99 | 1 | 0.99 | 1.98 |
| NACE, 14 days, 110° F. | B+ | A | A | B+ | B+ | B+ | A | B+ |

TABLE 6

| Base Gasoline | #1 | #2 | #3 | #4 |
|---|---|---|---|---|
| Specific Gravity 60° F./60° F.[1] | 0.7614 | 0.7535 | 0.7502 | 0.7514 |
| Reid vapor pressure, psi | 5.98 | 7.29 | 7.41 | 6.97 |
| Distillation, ° F.[2] | | | | |
| Initial boiling point | 100.1 | 94.1 | 96.1 | 91.6 |
| 10 ml[3] | 158.1 | 139.2 | 139.1 | 145 |
| 30 ml | 195.4 | 175.4 | 169.1 | 187.1 |
| 50 ml | 222.7 | 210.3 | 203 | 230.6 |
| 70 ml | 248.2 | 234.3 | 229.9 | 269.1 |
| 90 ml | 333.7 | 289 | 275 | 314.9 |
| Final boiling point | 419.9 | 388.1 | 387.6 | 372.1 |
| Research octane number | 92.2 | 92.9 | 92.9 | 92.6 |
| Motor octane number | 84.5 | 84.2 | 84.4 | 84.3 |
| Aromatics, vol % | 35.6 | 37.4 | 37.2 | 30.5 |
| Olefins, vol % | 6.3 | 10.7 | 10.8 | 5.2 |

[1]Density of gasoline at 60° F. relative to density of water at 60° F.
[2]Distillation - ASTM Method D86
[3]ml—milliliters evaporated

Examples 21-27

NACE Testing of Corrosion Inhibitors in OCTAMIX Compositions

Summary:

Corrosion performance of three commercial corrosion inhibitor additives in gasoline blends was evaluated by the National Association of Corrosion Engineers (NACE) Standard Test Method TM0172—Determining Corrosive Properties of Cargoes in Petroleum Product Pipelines. Base gasoline and blends using two different oxygenate mixes were tested. All blends gave acceptable performance in both fresh blends and blends heat aged for up to 12 weeks at 110° F., thereby indicating satisfactory performance of the additives.

Materials—

Test Fuel Components:

1. Base gasoline of all-hydrocarbon composition including only refinery process additive, i.e., no detergent or other performance additives typically added at distribution terminals. The base gasoline had poor performance (C rating) on the NACE test.
2. "OCTAMIX #1" methanol with co-solvents alcohol composition, as listed in Table 7.
3. "OCTAMIX #2" isobutanol alcohol composition, as listed in Table 7.
4. Corrosion inhibitor additives
   a. Afton BioTEC® 9880
   b. Afton BioTEC® 9881
   c. Lubrizol® 541

TABLE 7

| OCTAMIX Alcohol Compositions | | |
|---|---|---|
| Material | OCTAMIX #1 | OCTAMIX #2 |
| Methanol | 65.57 | |
| Ethanol | 9.3 | |
| Propanol | 4.2 | |
| n-Butanol | | |
| Iso-Butanol | 5.8 | 100.0 |
| n-Pentanol | | |
| Iso-Pentanol | 6.75 | |
| n-Hexanol | | |
| Iso-Hexanol | 4.75 | |
| n-Heptanol | 1.0 | |
| n-Octanol | 0.2 | |
| Methyl iso-propyl ketone | | |
| Methyl iso-butyl ketone | 1.5 | |
| n-Pentyl Acetate | 0.65 | |
| Water | 0.08 | |
| n-heptane | 0.2 | |
| Total | 100.0 | 100.0 |
| Total Cosolvent Alcohols | 31.95 | 100.0 |
| Total C2-C4 Alcohols | 19.3 | 100 |
| Total C5-C8 Alcohols | 12.7 | 0 |

Gasoline/Alcohol Fuel Blends:

1. C-9 base fuel: base gasoline with no added alcohol or corrosion inhibitor
2. T-9 test fuel: base gasoline with 7.6 vol % OCTAMIX #1 (methanol with co-solvents)
3. T-9b test fuel: base gasoline with 16 vol % OCTAMIX #2 (iso-butanol) added at 16% and added candidate corrosion inhibitor at specified treat rate Blend compositions are summarized in Table 8.

TABLE 8

| Gasoline/Alcohol Fuel Blend Compositions | | | |
|---|---|---|---|
| Blend ID | Base Gasoline, vol % | OCTAMIX #1 (methanol with co-solvents), vol % | OCTAMIX #2 (isobutanol), vol % |
| C-9 | 100 | 0 | 0 |
| T-9 | 92.4 | 7.6 | 0 |
| T-9b | 84.0 | 0 | 16.0 |

Test Method:

NACE Standard Test Method TM0172—Determining Corrosive Properties of Cargoes in Petroleum Product Pipelines (NACE test) was used to evaluate corrosion performance on all samples. Samples consisted of fresh preparations of the Gasoline/Alcohol Fuel Blends with additive as well as identical preparations which were subsequently heat aged prior to the NACE test. Heat aged samples were aged in plastic coated glass bottles with Teflon™ liners in the plastic caps. Heat-aging bottles were submerged in the water of a bath controlled at 110° F.

Procedure:

1. Prepare sufficient quantities of test fuels for fresh and aged NACE tests.

2. Perform NACE test on fresh fuels.
3. Age additional test fuel samples at 110° F. for 30 days.
4. Perform NACE test on fuels aged 30 days.
5. Age additional test fuel samples at 110° F. for 12 weeks.
6. Perform NACE test on fuels aged 12 weeks.

Results:

Three EPA-registered, commercially-available corrosion inhibitors were tested at specific concentrations: Afton BioTEC® 9880 at 4.56 mg/L, Afton BioTEC® 9881 at 11.4 mg/L, and Lubrizol® 541 at 11.4 mg/L. All fresh blends of the fuels gave NACE ratings of A (no rust). After heat aging for 30 days and 12 weeks all the blends gave acceptable NACE ratings of B+ of better, ranging from B+ (2% rust) to A (no rust). A NACE rating of B+ on a fresh blend is generally required by common carrier pipeline fuel specifications. The unadditized base fuel gave a NACE rating of C (30% rust) for the fresh and both heat aged samples. Results are summarized in Table 9.

TABLE 9

Corrosion Test Results

| Composition ID (Example) | Gasoline/ Alcohol Fuel Blend | Corrosion Inhibitor Additive | Additive treat rate, mg/L (ptb) | Fresh samples | Heat-aged 30 days | Heat-aged 12 weeks |
|---|---|---|---|---|---|---|
| 21 | C9 | None | | C (30%) | C (30%) | C (30%) |
| 22 | T9 | Afton BioTEC ® 9880 | 4.56 (1.6) | A | A | B+ (2%) |
| 23 | T9b | Afton BioTEC ® 9880 | 4.56 (1.6) | A | A | B++ (1 spot) |
| 24 | T9 | Afton BioTEC ® 9881 | 11.4 (4.0) | A | B++ (1 spot) | A |
| 25 | T9b | Afton BioTEC ® 9881 | 11.4 (4.0) | A | A | A |
| 26 | T9 | Lubrizol ® 541 | 11.4 (4.0) | A | A | B++ (2 spots) |
| 27 | T9b | Lubrizol ® 541 | 11.4 (4.0) | A | A | B+ (<1%) |

Afton Bio TEC® 9880, Afton BioTEC® 9881 and Lubrizol® 541 all provided superior performance in corrosion protection, resulting in fuel blends that gave acceptable NAGE ratings of B+ or better after heat aging for 30 days and 12 weeks, indicating that these corrosion inhibitors will provide protection from corrosion for long term ambient storage of fuel blends. In addition, these inhibitors provided sufficient protection from corrosion at low treat rates of less than 5 ptb, making them more economical. The effective corrosion inhibitors comprise alkenyl succinic acids, where the alkenyl groups are isomers of tetrapropenyl, without neutralizing amine (Afton BioTEC® 9880), or with about 9 equivalents of neutralizing amine such as N,N-dimethyl cyclohexyl amine (Afton BioTEC® 9881), or a bis ester without neutralizing amine where the ester link is a glycol as described in U.S. Pat. No. 3,177,091 (Lubrizol® 541).

Examples 28-33

Lubrizol® 541 in combination with BioTEC® 9880, and a high dose (15 ptb) of BioTEC® 9881 were also tested according to the procedure described above for Examples 21-27. The data from these additional tests are summarized in Table 10.

TABLE 10

Additional Identified Corrosion Inhibitor Additive Providing Up To 12 Week Corrosion Protection

| | ID (Example) | | | | | |
|---|---|---|---|---|---|---|
| Material | 28 | 29 | 30 | 31 | 32 | 33 |
| Base gasoline 4, vol % | 84 | 92.4 | 84 | 84 | 92.4 | 84 |
| Octamix, vol % | 7.6 | | 7.6 | | 7.6 | |
| iso-BuOH, vol % | | 16 | | 16 | | 16 |
| Lubrizol 541, ptb | 4 | 4 | 4 | 4 | | |
| BioTEC 9880, ptb | | | 1.6 | 1.6 | | |
| BioTEC 9881, ptb | | | | | 15 | 15 |
| NACE, fresh | A | A | nt | nt | nt | nt |

TABLE 10-continued

Additional Identified Corrosion Inhibitor Additive Providing Up To 12 Week Corrosion Protection

| | ID (Example) | | | | | |
|---|---|---|---|---|---|---|
| Material | 28 | 29 | 30 | 31 | 32 | 33 |
| NACE, 30 days, 110 F. | A | A | A | A | A | A |
| NACE, 12 weeks, 110 F. | B++(2 spts) | B+(<1) | B+(6-8 spts) | A | A | A |

nt = not tested, expect these to be "A"

Table 10 also shows that Afton BioTEC® 9880, Afton BioTEC® 9881, and Lubrizol® 541 provided protection from corrosion, resulting in fuel blends that gave acceptable NACE ratings of B+ or better after heat aging for 30 days and 12 weeks. Although the higher treat rate of 15 ptb of BioTEC® 9881 resulted in fuel blends having acceptable NACE ratings, the lower treat rates of 4 ptb of Lubrizol® 541 and 1.6 ptb of BioTEC® 9880, either added individually or in combination, also achieved acceptable NACE ratings. A high treat rate of BioTEC® 9881 did not impair performance (compare runs 32 and 33 with 9, 10, 11, 12) as observed for other additives. Combinations of Lubrizol®

541 with BioTEC® 9880 did not exhibit antagonism that impaired performance (compare 30 and 31 with 22, 23, 28 and 29).

Examples 34-48

Additional tests were performed using Lubrizol® 541, BioTEC® 9880, and BioTEC® 9881 according to the procedure described above for Examples 21-27. The data from these additional tests are summarized in Tables 11 and 12.

TABLE 11

Identified Corrosion Inhibitor Additives Providing Corrosion Protection After 30 Days Heat Aging

| | Material ID (Example) | | | | | | | | | |
|---|---|---|---|---|---|---|---|---|---|---|
| | 34 | 35 | 36 | 37 | 38 | 39 | 40 | 41 | 42 | 43 |
| Base gasoline 3, vol % | 92.4 | 84 | 84 | 92.4 | 84 | 92.4 | 92.4 | 84 | 84 | 92.4 |
| Octamix, vol % | 7.6 | | | 7.6 | | 7.6 | 7.6 | | | 7.6 |
| Iso-BuOH, vol % | | 16 | 16 | | 16 | | | 16 | 16 | |
| LZ 541, ptb | 2.4 | 2.4 | | | | | 4 | 4 | | |
| BioTEC 9880, ptb | | | 1.6 | 1.6 | | | | | | |
| BioTEC 9881, ptb | | | | | 2.4 | 2.4 | | | 4 | 4 |
| NACE, fresh | | | B+(<1) | B+(<1) | A | A | | | | |
| NACE, 30 days, 110 F. | C(40) | A | A | A | A | B+(15 spots) | A | B(25) | B+(5) | A |
| NACE, 12 weeks, 110 F. | E | C(25) | E | C(40) | C(40) | C(40) | B(25) | E(95) | E(90) | B(15) |

TABLE 12

Identified Corrosion Inhibitor Additives Providing Up To 12 Weeks Corrosion Protection

| | Material ID (Example) | | | | |
|---|---|---|---|---|---|
| | 44 | 45 | 46 | 47 | 48 |
| Base gasoline 4, vol % | 100 | 92.4 | 84 | 92.4 | 84 |
| Octamix, vol % | | 7.6 | | 7.6 | |
| Iso-BuOH, vol % | | | 16 | | 16 |
| BioTEC 9880, ptb | | | | 1.6 | 1.6 |
| BioTEC 9881, ptb | | 4 | 4 | | |
| NACE, fresh | C(30) | A | A | A | A |
| NACE, 30 days 110 F. | C(30) | B++(1 spot) | A | A | A |
| NACE, 12 weeks, 110 F. | C(30) | A | A | B+(2) | B++(1 spot) |

Table 11 shows Lubrizol® 541, BioTEC® 9880, and BioTEC® 9881 providing corrosion protection after 30 days of heat aging in a severe base gasoline (gasoline 3) for both methanol/cosolvent and iso-butanol blends, while Table 12 shows BioTEC® 9880 and BioTEC® 9881 providing corrosion protection after 12 weeks of heat aging in a less severe base gasoline (gasoline 4).

Fuel additive chemistries are known that have proven to be insoluble in high concentrations of oxygenates, such as poly isobutylene amine (PIBA) in high concentrations of ethanol. It is desired that the combination of corrosion inhibitors of the present invention at the desired treat rates are completely soluble. The Modified MOBIL Filterability Test, or an equivalent test correlating to real world data may be used to test for solubility.

From the above description, it is apparent that the objects of the present invention have been achieved. While only certain embodiments have been set forth, alternative embodiments and various modifications will be apparent from the above description to those skilled in the art and are within the spirit and scope of the present invention.

All publications, patents and patent applications mentioned in this specification are indicative of the level of skill of those skilled in the art to which this invention pertains, and are herein incorporated by reference to the same extent as if each individual publication, patent or patent application was specifically and individually indicated to be incorporated by reference for all purposes.

What is claimed:

1. A gasoline composition comprising a gasoline blend stock, 2 to 24 v/v % isobutanol, an amount of one or more corrosion inhibitors wherein said amount is about 1 ptb to 4 ptb and wherein said one or more corrosion inhibitors comprises at least one reaction product of a combination of at least one organic acid, at least one dimer acid, or at least one trimer acid with at least one amine and said one or more corrosion inhibitors have an acid/amine equivalence ratio of about 0.1 to about 3, and a reaction product of an aldehyde or a ketone with an aliphatic hydrocarbyl substituted amine, a hydrocarbyl-substituted poly(oxyalkylene) amine, a hydrocarbyl-substituted succinimide, or a polyalkylphenoxyamino-alkane.

2. The gasoline composition of claim 1, wherein the organic acid is tricarboxylic acid.

3. The gasoline composition of claim 1, wherein the amine is a fatty diamine, fatty amine, polyamine, ether amine, or ether diamine.

4. The gasoline composition of claim 1, wherein the aliphatic hydrocarbyl-substituted amine is a polyisobutenyl monoamine, a polyisobutyl monoamine, a polyisobutenyl polyamine, or a polyisobutyl polyamine.

5. The gasoline composition of claim 1, wherein the hydrocarbyl-substituted poly(oxyalkylene) amine is alkylphenyl poly(oxybutylene) aminocarbamate.

6. The gasoline composition of claim 1, wherein the isobutanol is biologically-derived isobutanol.

7. The gasoline composition of claim 1, wherein the composition comprises 16 v/v % isobutanol.

* * * * *